US008312683B2

(12) United States Patent
Tadros et al.

(10) Patent No.: US 8,312,683 B2
(45) Date of Patent: Nov. 20, 2012

(54) METHOD FOR CONSTRUCTING PRECAST SANDWICH PANELS

(76) Inventors: Maher K. Tadros, Omaha, NE (US); Mark D. Lafferty, Lincoln, NE (US); Doug Gremel, Seward, NE (US)

( * ) Notice: Subject to any disclaimer, the term of this patent is extended or adjusted under 35 U.S.C. 154(b) by 0 days.

(21) Appl. No.: 12/882,305

(22) Filed: Sep. 15, 2010

(65) Prior Publication Data

US 2011/0061329 A1 Mar. 17, 2011

Related U.S. Application Data

(60) Provisional application No. 61/242,441, filed on Sep. 15, 2009.

(51) Int. Cl.
*E04C 1/00* (2006.01)

(52) U.S. Cl. ..... 52/309.11; 52/309.7; 52/309.16; 52/428; 52/794.1; 52/796.1

(58) Field of Classification Search ..... 52/309.12, 52/309.11, 309.7, 309.16, 309.17, 794.1, 52/796.1, 596, 105, 309.07, 426, 427, 428, 52/432

See application file for complete search history.

(56) References Cited

U.S. PATENT DOCUMENTS 4,104,842 A * 8/1978 Rockstead et al. ..... 52/649.1
4,253,288 A * 3/1981 Chun ..... 52/454
4,283,896 A 8/1981 Fricker et al.
4,624,089 A 11/1986 Dunker
4,628,653 A 12/1986 Nash
4,669,240 A * 6/1987 Amormino ..... 52/236.6
4,974,381 A 12/1990 Marks
5,058,345 A * 10/1991 Martinez ..... 52/309.11
5,234,220 A * 8/1993 Schellhammer et al. ..... 473/578
5,440,845 A 8/1995 Tadros et al.
5,673,525 A 10/1997 Keith et al.
5,996,297 A 12/1999 Keith et al.
6,088,985 A * 7/2000 Clark ..... 52/309.11
6,854,229 B2 2/2005 Keith et al.
6,895,720 B2 5/2005 Keith
7,206,726 B2 4/2007 Seeber et al.
2003/0167716 A1* 9/2003 Messenger et al. ..... 52/309.12
2006/0032166 A1 2/2006 Devalapura
2006/0284328 A1 12/2006 Pantelides et al.
2007/0107375 A1 5/2007 Long

* cited by examiner

*Primary Examiner* — Brian Glessner
*Assistant Examiner* — Brian D Mattei
(74) *Attorney, Agent, or Firm* — Suiter Swantz pc llo

(57) ABSTRACT

The present disclosure is directed to a concrete sandwich panel. The sandwich panel may comprise a first reinforced concrete panel; a second reinforced concrete panel; an insulating panel sandwiched between the first reinforced concrete panel and the second reinforced concrete panel; a tie comprising a generally triangle wave-shaped pattern having a period defined by peaks spaced at a regular interval and a peak-to-peak amplitude greater than the thickness of the insulating panel; wherein the insulating panel has a plurality of generally linear slots defined at the regular interval of the tie for receiving the tie such that opposing ends of the tie terminate adjacent to the insulating panel, and the plurality of generally linear slots are filled utilizing an insulating material upon insertion of the tie to reduce thermal bridging; and wherein the peaks of the tie mechanically join the first and second reinforced concrete panels to the insulating panel.

9 Claims, 31 Drawing Sheets

METHOD FOR CONSTRUCTING PRECAST SANDWICH PANELS

CROSS-REFERENCE TO RELATED APPLICATIONS

The present application claims the benefit under 35 U.S.C. §119(e) of U.S. Provisional Application Ser. No. 61/242,441, filed Sep. 15, 2009. Said U.S. Provisional Application Ser. No. 61/242,441 is hereby incorporated by reference in its entirety.

TECHNICAL FIELD

The disclosure generally relates to the field of precast sandwich panels, particularly to a method for constructing precast sandwich panels.

BACKGROUND OF THE INVENTION

Precast concrete is a form of construction, where concrete is cast in a reusable mould or form which is then cured in a controlled environment. A precast sandwich panel (may also be referred to as double wall precast) may include two wythes (panels or layers) of reinforced concrete sandwiched around an insulating layer having a high R-value (a measure of thermal resistance). The insulation layer may be continuous throughout the wall section, and the two wythes of the interior and exterior concrete layers may be held together with trusses or ties.

SUMMARY OF THE INVENTION

The present disclosure is directed to a concrete sandwich panel. The concrete sandwich panel may comprise a first reinforced concrete panel; a second reinforced concrete panel; an insulating panel sandwiched between the first reinforced concrete panel and the second reinforced concrete panel; a tie comprising a generally triangle wave-shaped pattern having a period defined by peaks spaced at a regular interval and a peak-to-peak amplitude greater than the thickness of the insulating panel; wherein the insulating panel has a plurality of generally linear slots defined at the regular interval of the tie for receiving the tie such that opposing ends of the tie terminate adjacent to the insulating panel, and the plurality of generally linear slots are filled utilizing an insulating material upon insertion of the tie to reduce thermal bridging; and wherein the peaks of the tie mechanically join the first and second reinforced concrete panels to the insulating panel.

A further embodiment of the present disclosure is directed to a method for constructing a concrete sandwich panel. The method may comprise configuring a first reinforcement installation; forming a first reinforced concrete panel having the first reinforcement installation embedded within; placing an insulating panel on top of the first reinforced concrete panel, the insulating panel comprising a tie having a generally triangle wave-shaped pattern, the generally triangle wave-shaped pattern having a period defined by peaks spaced at a regular interval and a peak-to-peak amplitude greater than the thickness of the insulating panel, the insulating panel having a plurality of generally linear slots defined at the regular interval of the tie for receiving the tie such that opposing ends of the tie terminate adjacent to the insulating panel; configuring a second reinforcement installation; forming a second reinforced concrete panel having the second reinforcement installation embedded within.

An additional embodiment of the present disclosure is directed to a tie for joining an insulating panel sandwiched between two reinforced concrete panels, the tie comprising a generally triangle wave-shaped pattern having a period defined by peaks spaced at a regular interval and a peak-to-peak amplitude greater than the thickness of the insulating panel, wherein the improvement comprises the tie having a length which is a segment of a length of the concrete panels; and the tie is positioned in the insulating panel through a plurality of generally linear slots defined at the regular interval of the tie, wherein opposing ends of the tie terminate adjacent to the insulating panel.

An additional embodiment of the present disclosure is directed to an insulating panel. The insulating panel may comprise a tie comprising a generally triangle wave-shaped pattern having a period defined by peaks spaced at a regular interval and a peak-to-peak amplitude greater than the thickness of the insulating panel; and a plurality of generally linear slots in the insulating panel defined at the regular interval of the tie for receiving the tie such that opposing ends of the tie terminate adjacent to the insulating panel.

An additional embodiment of the present disclosure is directed to a method for constructing an insulating panel. The method may comprise defining a plurality of generally linear slots in the insulating panel at a regular interval for receiving a tie, wherein the tie comprising a generally triangle wave-shaped pattern having a period defined by peaks spaced at the regular interval and a peak-to-peak amplitude greater than the thickness of the insulating panel; inserting the tie into the insulating panel at the plurality of generally linear slots such that opposing ends of the tie terminate adjacent to the insulating panel; sealing the plurality of generally linear slots utilizing an insulating material upon insertion of the tie.

An additional embodiment of the present disclosure is directed to an apparatus. The apparatus may comprise a frame for supporting for an insulating board; a track slidably connected to the frame for translating in a direction generally parallel to the frame; and a slotting element slidably connected to the track for translating in a direction generally perpendicular to the frame; wherein the slotting element comprises a heating member for plunging into the insulating board to create a plurality of at least partially generally triangle wave-shaped pattern of slots.

An additional embodiment of the present disclosure is directed to a system. The system may comprise means for holding a plurality of insulating boards; means for cutting one of the plurality of insulating boards to a specified configuration; means for creating a plurality of at least a partial generally triangle wave-shaped pattern of slots in said insulating board; means for determining a thickness of said insulating board and inserting a tie into the plurality of slots of said insulting board, wherein the tie comprising a generally triangle wave-shaped pattern having a period defined by peaks spaced at a regular interval and a peak-to-peak amplitude greater than the thickness of said insulating board; means for injecting an amount of insulating material into the plurality of slots of said insulting board upon insertion of the tie; and means for curing said amount of insulating material injected.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Figure 1:
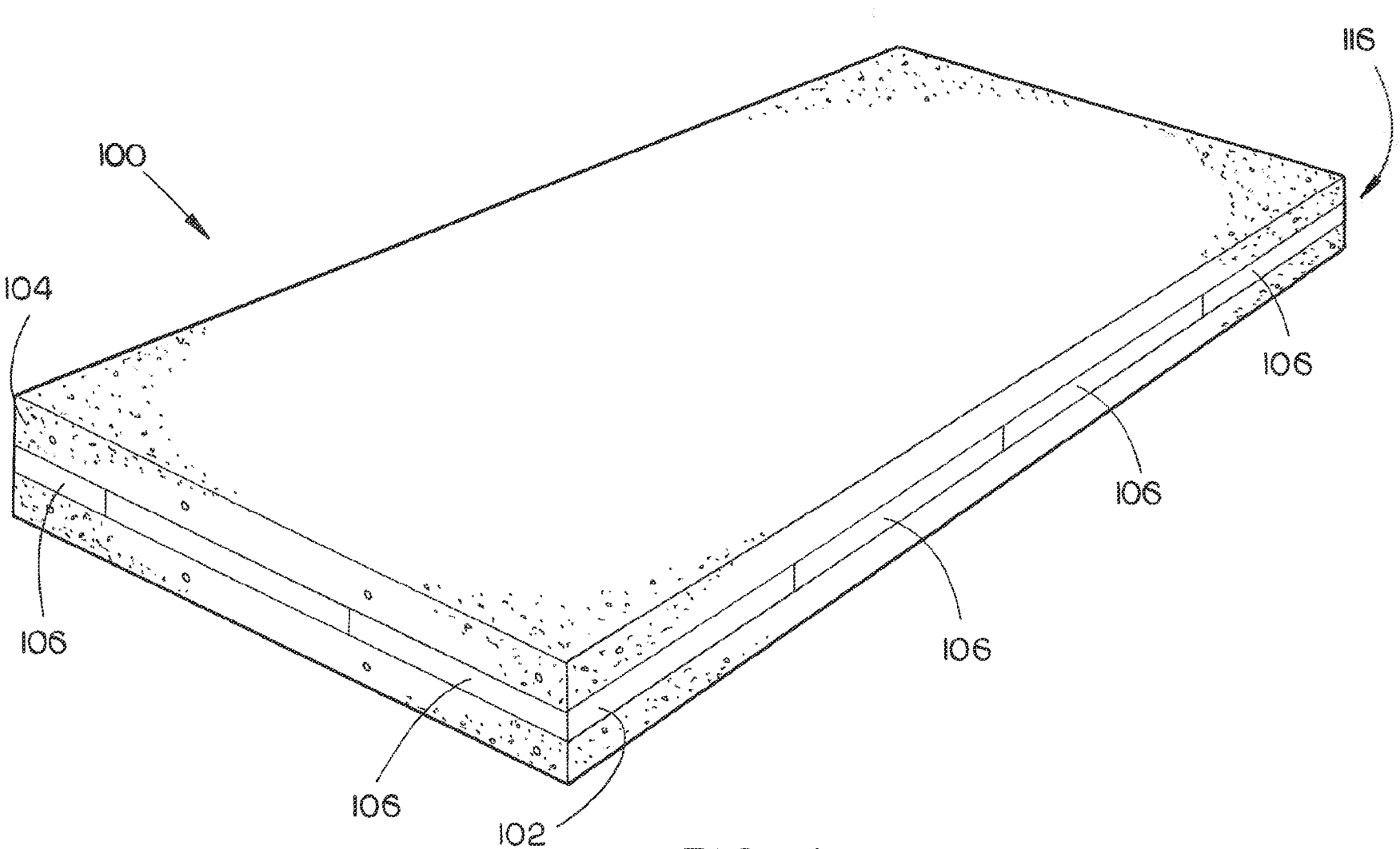
FIG. 1 is a perspective view of a concrete sandwich panel.
Figure 2:
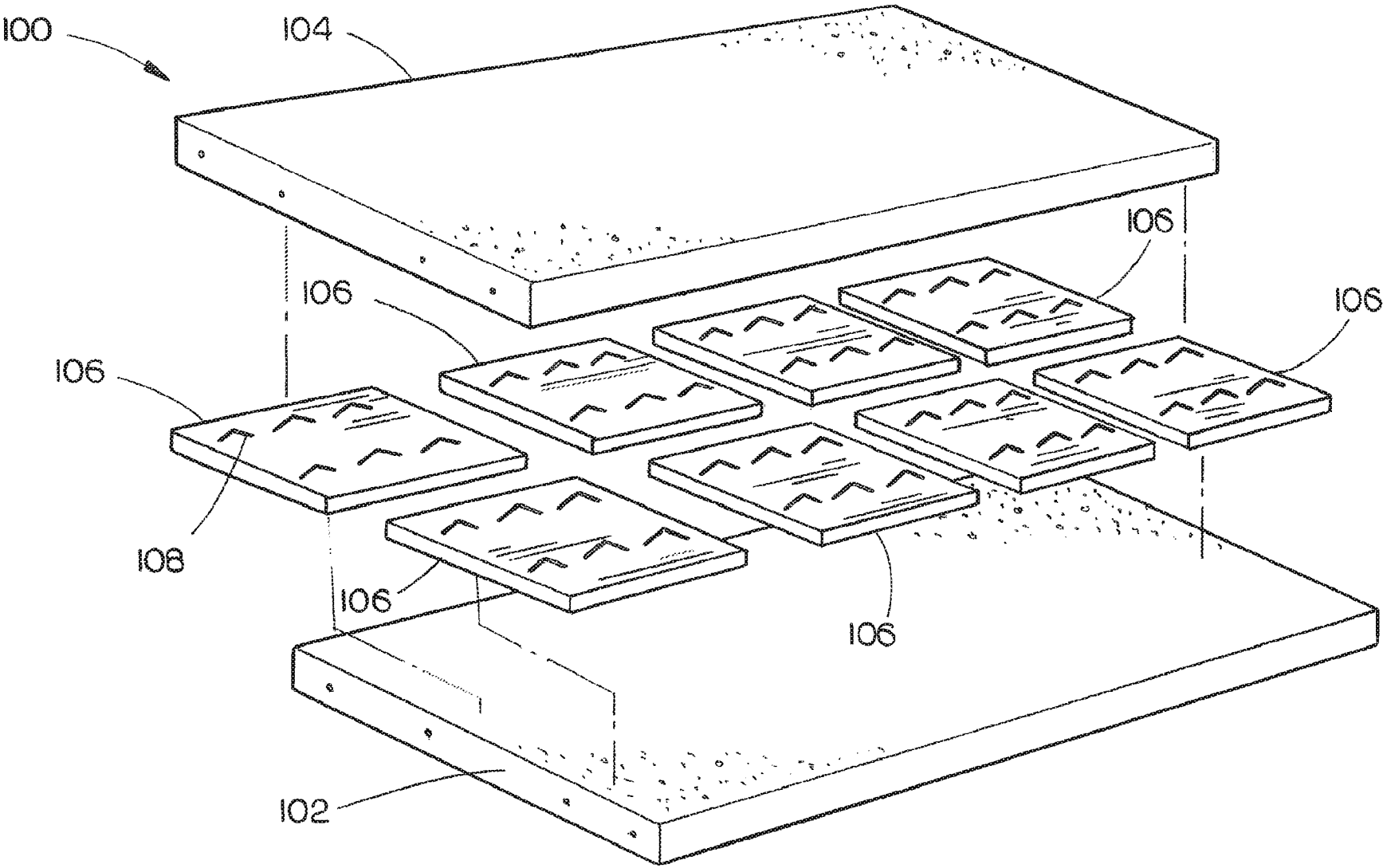
FIG. 2 is an exploded view of the concrete sandwich panel.
Figure 3:
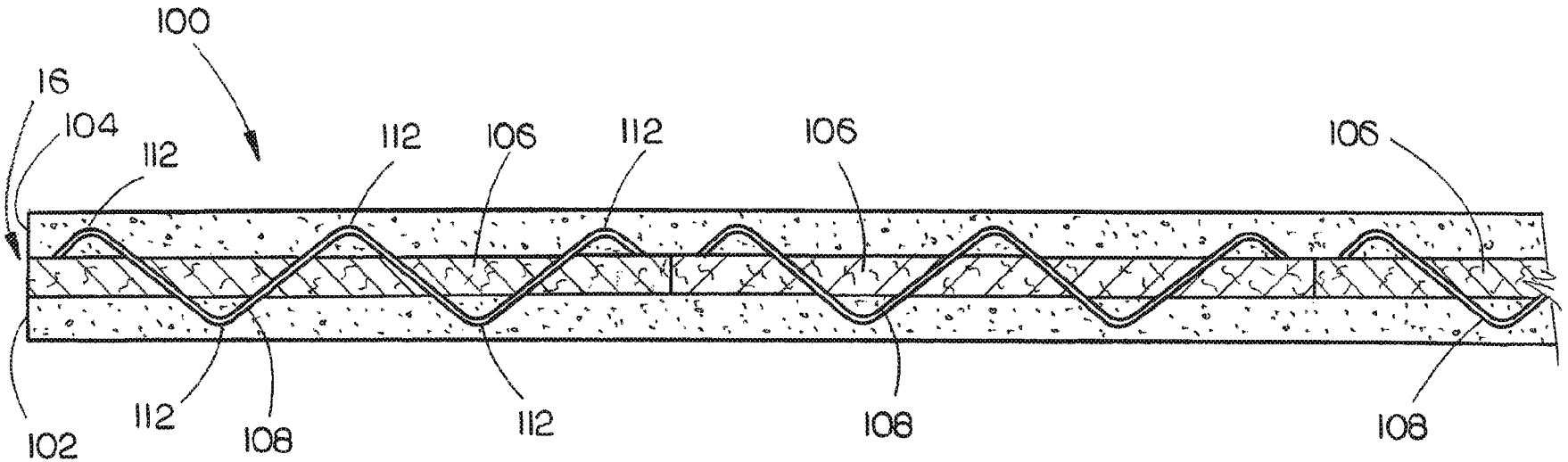
FIG. 3 is a partial cross-section side view of the concrete sandwich panel.
Figure 4:
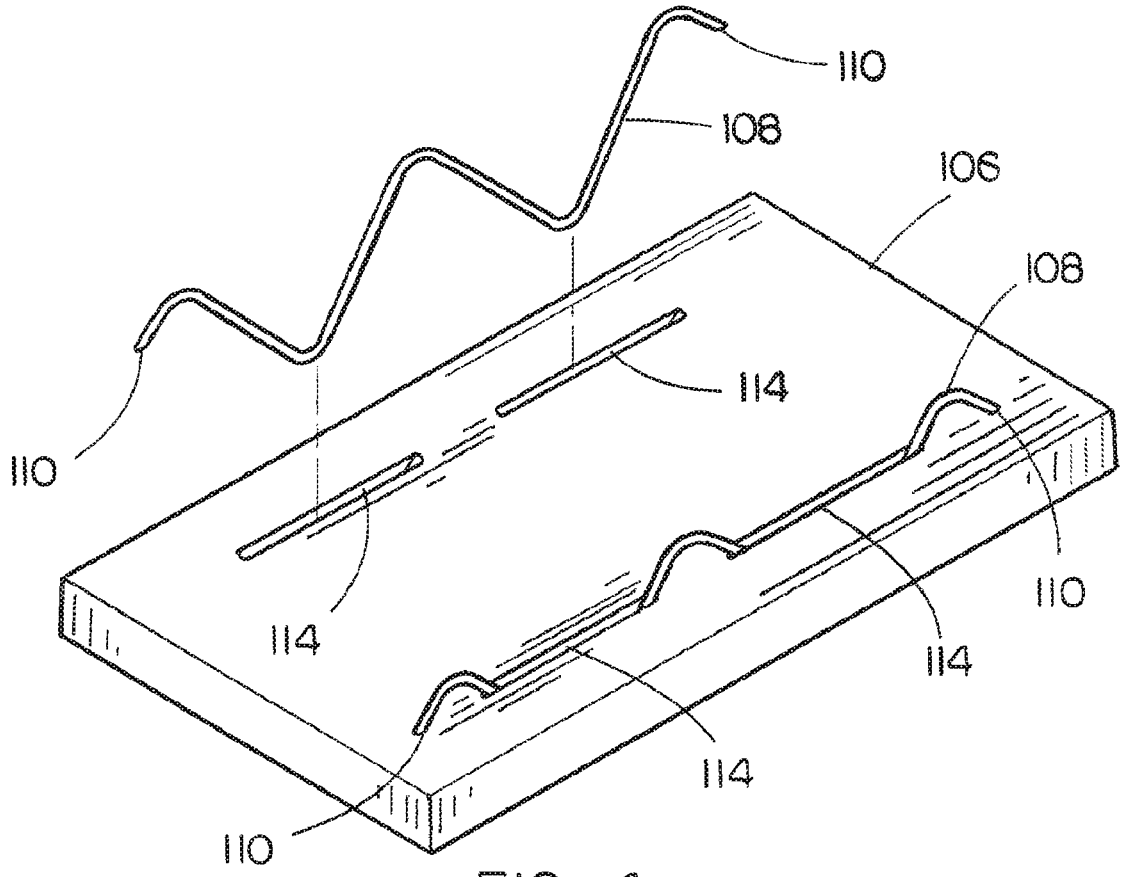
FIG. 4 is an isometric view of an insulating panel with a plurality of ties.
Figure 5:
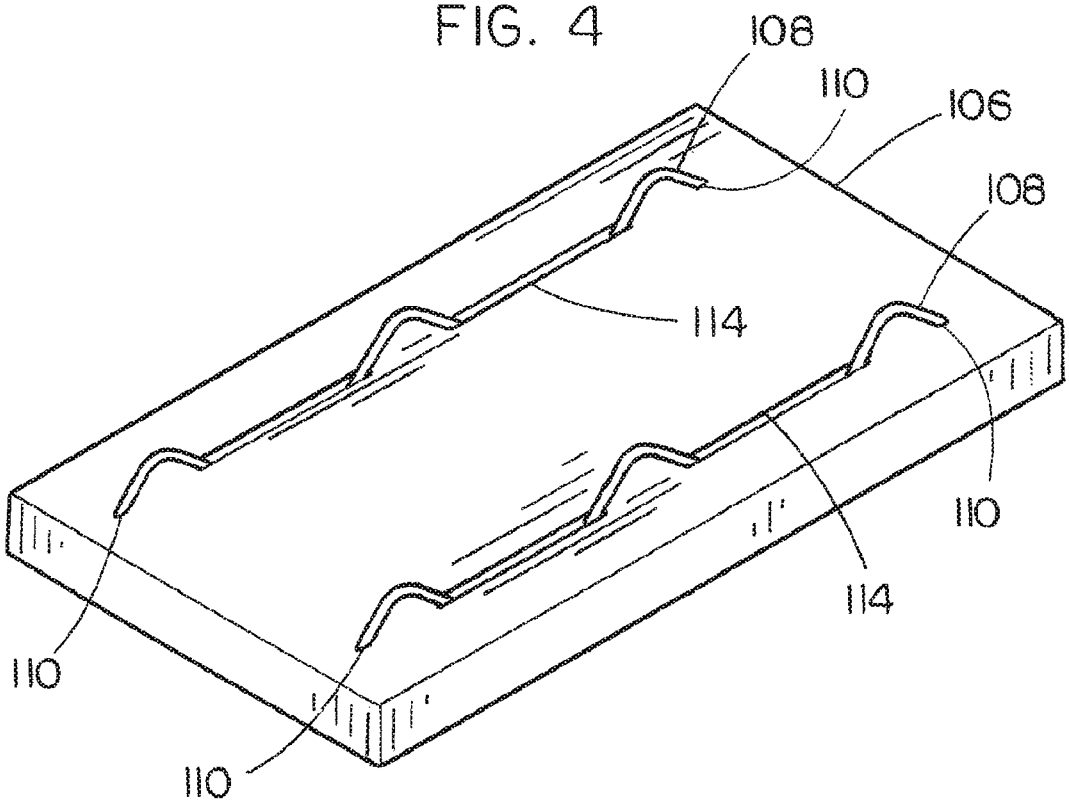
FIG. 5 is another isometric view of the insulating panel with a plurality of ties.
Figure 6:
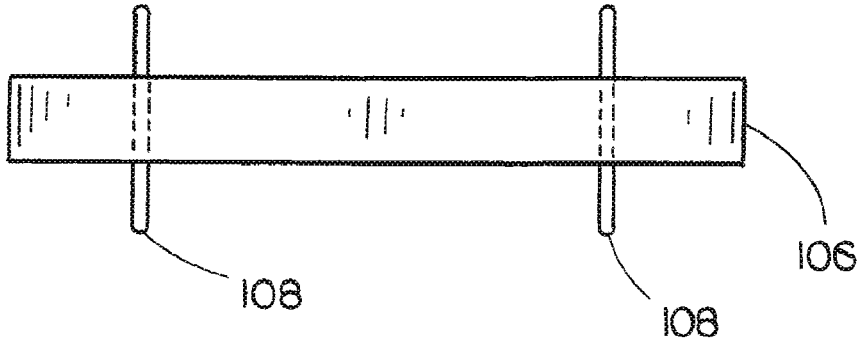
FIG. 6 is a side view of the insulating panel with a plurality of ties.
Figure 7:
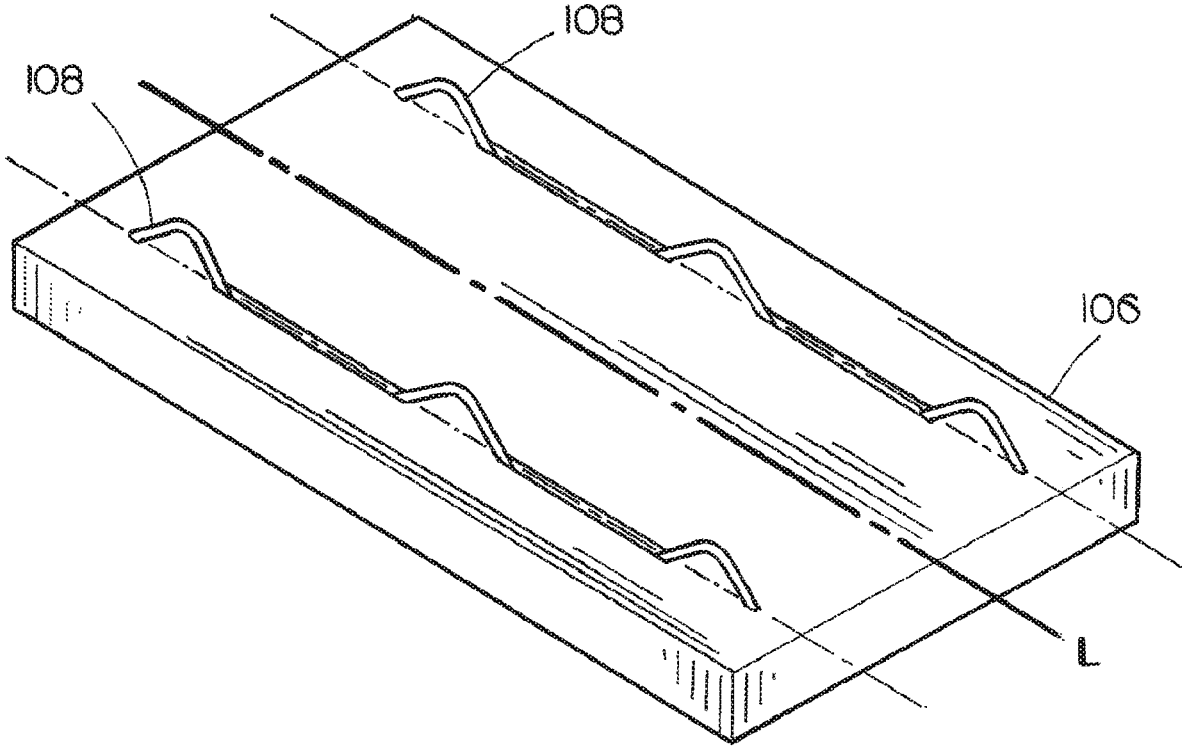
FIG. 7 is another isometric view of the insulating panel with a plurality of ties.
Figure 8:
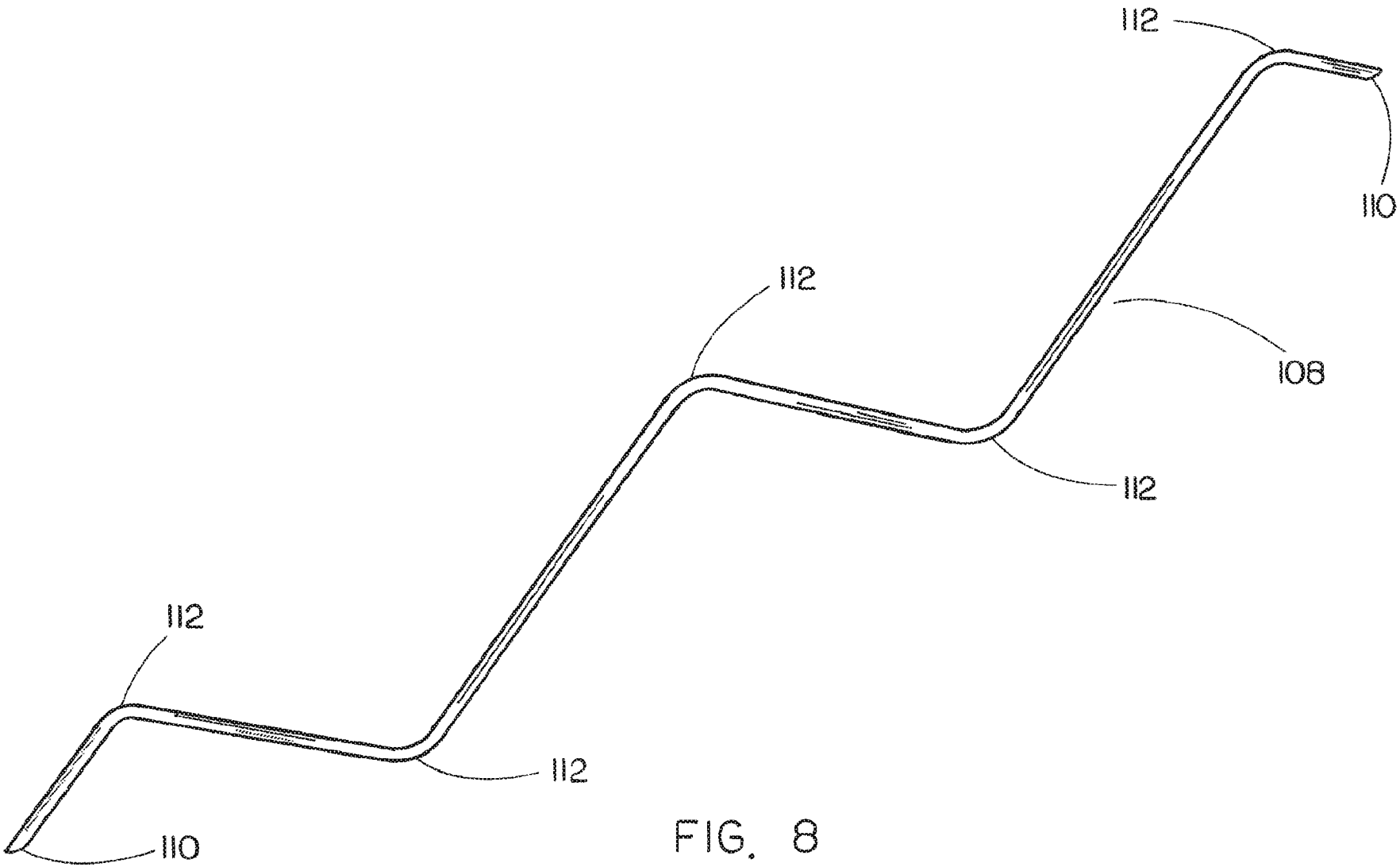
FIG. 8 is a side view of a tie.

Referring generally to FIGS. 1 through 3, a concrete sandwich panel 100 having an insulating layer 116 sandwiched between the first reinforced concrete panel/wythe 102 and the second reinforced concrete panel/wythe 104 is shown. The insulating layer 116 may be formed utilizing one or more insulating panels 106. An insulating panel 106 may utilize one or more ties 108 for mechanically joining the insulating panel 106 and the two reinforced concrete panels 102 and 104.

The tie 108 is configured in a generally triangle wave-shaped pattern having a period defined by peaks 112 spaced at a regular interval and a peak-to-peak amplitude greater than the thickness of the insulating panel. In one embodiment, the peaks 112 of the generally triangle wave-shaped pattern may be rounded. The generally triangle wave-shaped pattern of the tie 108 may have a wavelength of approximately 19 inches or greater. The tie 108 may be configured to have a generally circular cross-section having a diameter of approximately ⅜ of an inch or greater (e.g., depending on the specific application). Alternatively, the tie 108 may be is configured to have a generally rectangular cross-section having a width of approximately one inch.

While the tie may be made of various types of materials, the tie 108 of a particular embodiment may comprise a composite material having at least approximately 65% fiber glass. The composite material may also include various types of resins (e.g., Urethane resin or Vinyl Ester thermoset resin). In addition, sand may be utilized as a coating material for the tie 108.

The generally triangle wave-shaped pattern of the tie 108 is configured to provide shear force resistance for the sandwich panel 100. Shear forces in the sandwich panel 100 are resisted by the legs (i.e., the straight segments between two adjacent peaks of the generally triangle wave-shaped pattern) of the tie 108 positioned at an angle with respect to the longitudinal direction of the sandwich panel 100.

The ties 108 of the present disclosure do not form continuous wave-shaped patterns along the longitudinal direction of the sandwich panel 100. Instead, the ties 108 are segmented with respect to the length of the sandwich panel 100. In one embodiment, the length of the ties 108 may be determined based on the dimensions of the insulating panels 106. For example, if a rectangular insulating panel 106 is four feet wide and eight feet long, the ties may be configured to be less than four feet in length and may be inserted into the insulating panel in a direction that is parallel to the four feet edges. Alternatively, the ties may be configured to be less than eight feet in length and may be inserted into the insulating panel in a direction that is parallel to the eight feet edges.

Some of the advantages of the ties 108 being configured to be segmented may include, but not limited to, cost reductions, structural improvements, and increased energy efficiencies. For instance, less materials and/or labor may be required for manufacturing, handling (e.g., shipping) and installing the segmented ties 108 comparing to a continuous tie. In addition, the segmented ties 108 may be utilized for joining sandwich panels of any given length, which is advantageous over continuous ties designed for a particular length. Furthermore, the generally triangle wave-shaped pattern of the ties 108 may stretch when the sandwich panel 100 stretches (e.g., due to heating), effectively reducing thermal bowing and/or other structural concerns.

The ties 108 may be inserted into the insulating panels 106 prior to the concrete placement. Referring generally to FIGS. 4 through 9, an insulating panel 106 having slots 114 for receiving the ties 108 is illustrated. In one embodiment, the insulating panel 106 includes multiple generally linear slots 114 defined at the regular interval of the tie 108 for receiving the tie. To prevent/reduce thermal bridging between the two concrete panels 102 and 104 through the slots 114 of the insulating panels 106, an insulating material may be utilized to seal the slots 114 upon insertion of the ties 108. For example, an insulating foam sealant may be applied to the slots 114 for such sealing purposes.

Figure 9A:
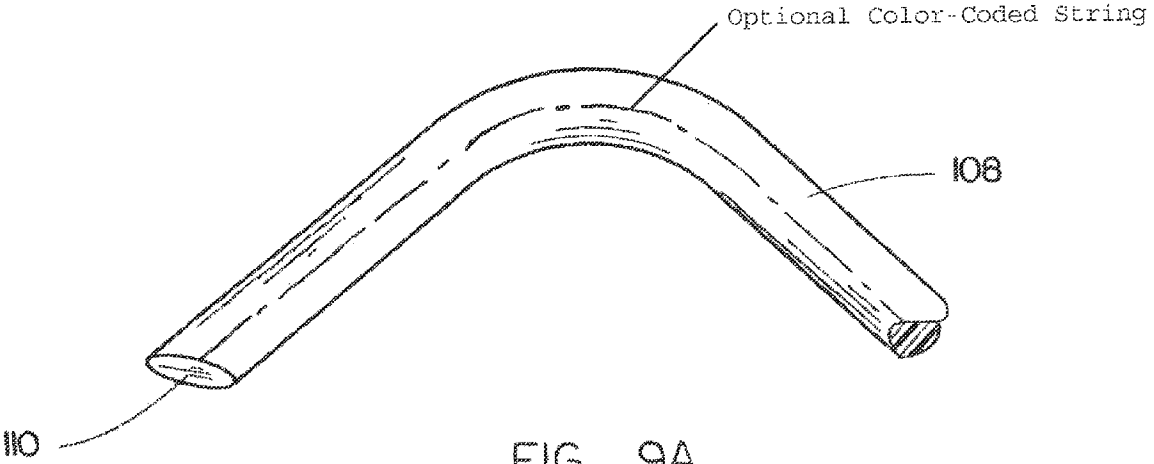
FIG. 9A is a partial side view of the tie.
Figure 9B:
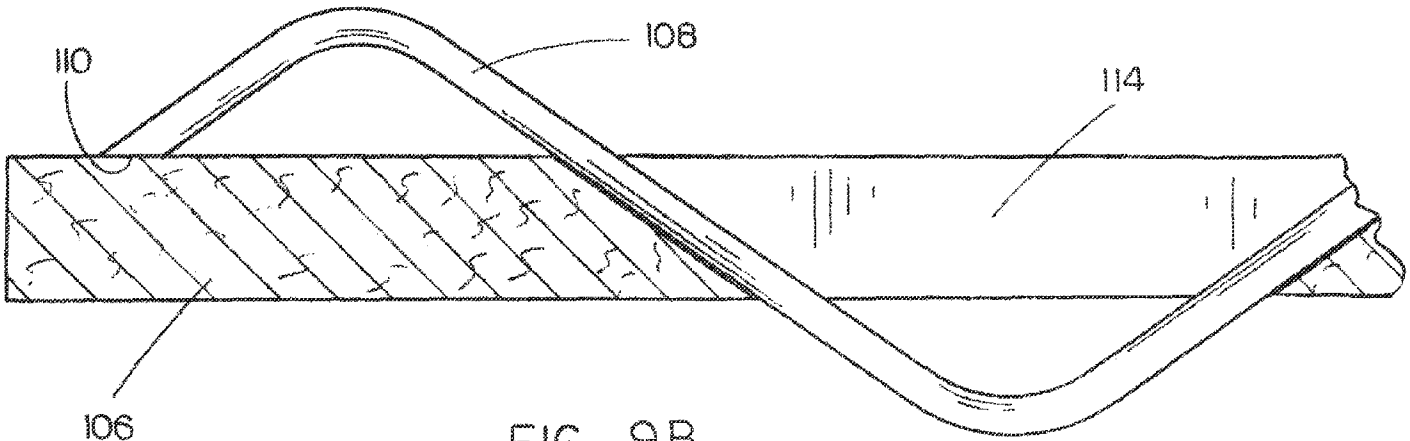
FIG. 9B is a partial cross-section side view of the tie inserted in to an insulating panel.

A self-positioning feature of the tie 108 is provided where the opposing ends 110 of the tie 108 terminate adjacent to the insulating panel 106 when the tie 108 is fully inserted into the insulating panel 106. That is, the opposing ends 110 of the tie 108 may rest on the insulating panel 106 when the tie 108 is fully inserted, reducing and/or eliminating the need for adjusting the depth of which the tie 108 is inserted. In one example, as illustrated in FIGS. 9A and 9B, the ends 110 of the tie 108 may be oriented generally parallel to a surface of the insulating panel 106 for terminating adjacent to the insulating panel. In this manner, substantially all surfaces of the opposing ends 110 of the tie 108 may be touching the surface of the insulating panel 106 when fully inserted.

It is contemplated that the reinforced concrete panels 102 and 104 may include reinforcement installations. For example, the reinforcement installations may include twisting moment resisting means such as one or more reinforcing bars (rebars). In addition, the reinforcement installations may also include tensile strength imparting means such as one or more prestressed cables. It is understood that in the concrete sandwich panel 100 of the present disclosure, the ties 108 are not secured to the reinforcement installations of the concrete panels 102 and 104.

It is also contemplated that the thickness of the concrete panels 102 and 104 may vary depending on the specific application. Furthermore, the thickness of the insulating layer 116 (hence the insulating panels 106) may also vary depending on the applications. Therefore, the geometry of the generally triangle wave-shaped pattern of the tie 108 may vary based on the thickness of the concrete panels and/or the thickness of the insulating panels.

Figure 10:
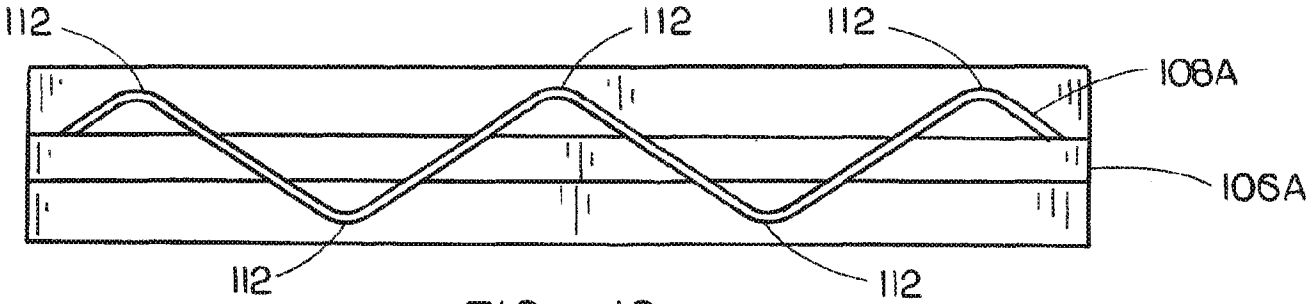
FIG. 10 is a side view of a tie inserted in to an insulating panel having a first thickness.
Figure 11:
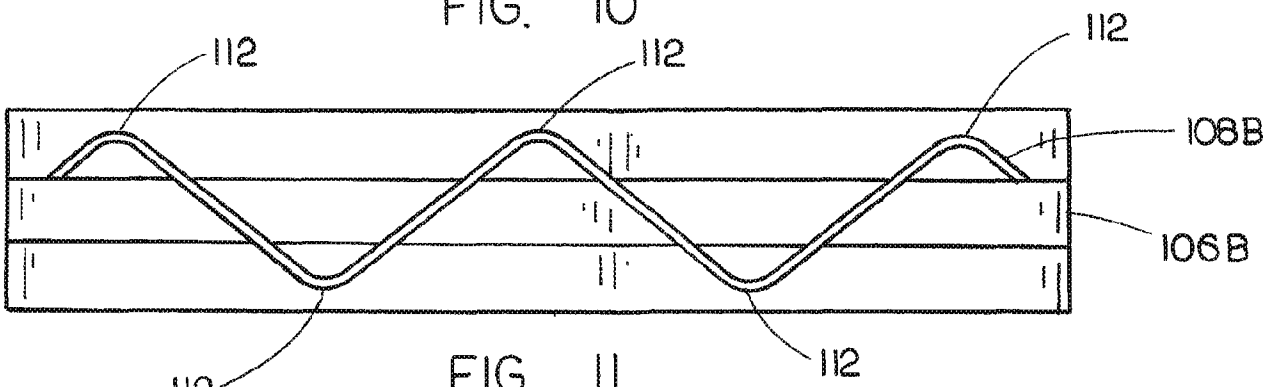
FIG. 11 is a side view of a tie inserted in to an insulating panel having a second thickness.
Figure 12:
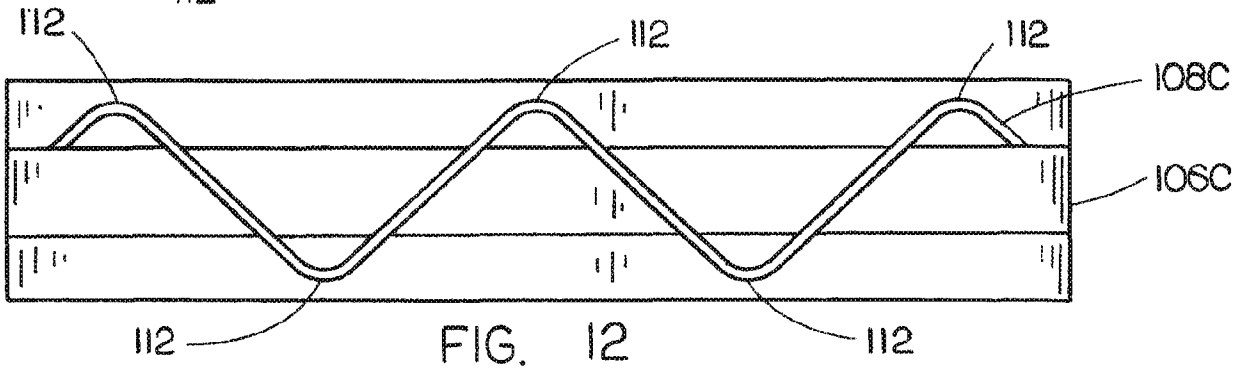
FIG. 12 is a side view of a tie inserted in to an insulating panel having a third thickness.

Referring generally to FIGS. 10 through 12, there is shown different ties configured for insulating panels having different thicknesses. For example, the thickness of the insulating panel 106C may be greater than the thickness of the insulating panel 106B, which may be greater than the thickness of the insulating panel 106A. Therefore, the peak-to-peak amplitude of the tie 108C may be greater than the peak-to-peak amplitude of the tie 108B, which may be greater than the peak-to-peak amplitude of the tie 108A.

It is understood that, in addition to the peak-to-peak amplitude, the wavelength, composition, and cross-sectional profile of the tie may also be configured differently based on the configurations and/or thicknesses of the concrete panels and/or insulating panels. It is contemplated that the ties may include identifiers/marks for identifying/indicating different peak-to-peak amplitudes, wavelengths, compositions, and/or cross-sectional profiles of the tie. In one embodiment, color-coded strings may be utilized as such identifiers.

Figure 13:
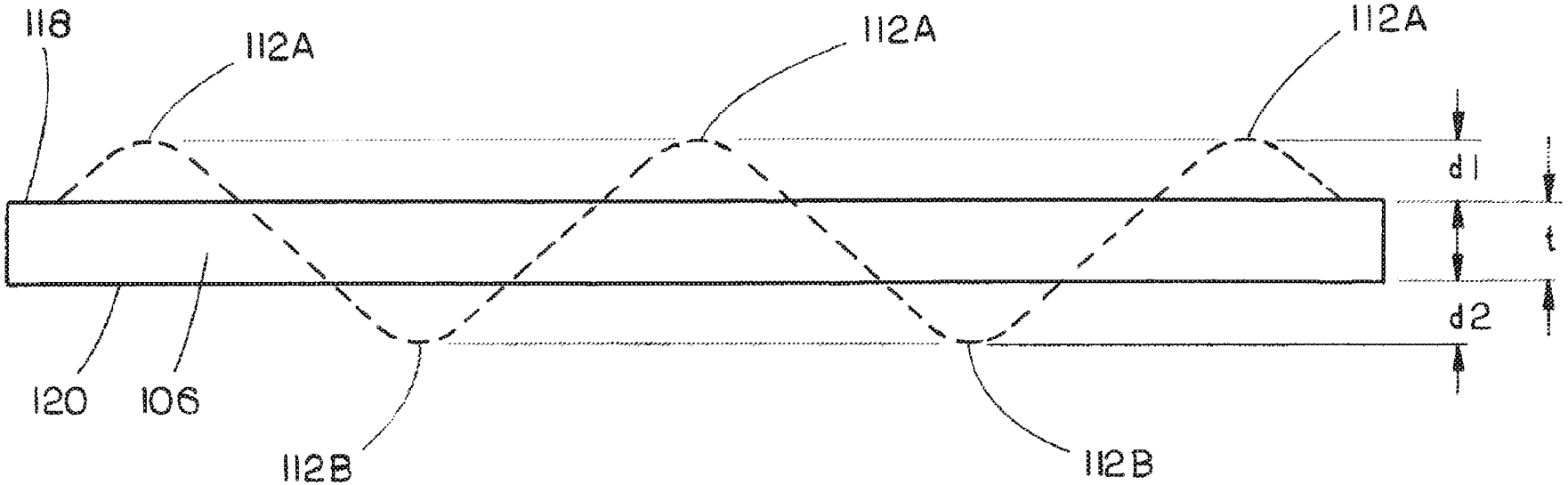
FIG. 13 is a side view of an insulating panel, illustrating a generally triangle wave-shaped pattern having a period defined by peaks spaced at a regular interval and a peak-to-peak amplitude greater than the thickness of the insulating panel.

Referring to FIG. 13, there is shown the position of a tie when fully inserted into the insulating panel 106. Distance d1 indicates the distance from the peaks 112A above surface 118 of the insulating panel to the surface 118. Distance d2 indicates the distance from the peaks 112B below surface 120 of the insulating panel to the surface 120. In applications where the thicknesses of both concrete panels are substantially equal, the distances d1 and d2 may also be substantially equal.

Figure 14:
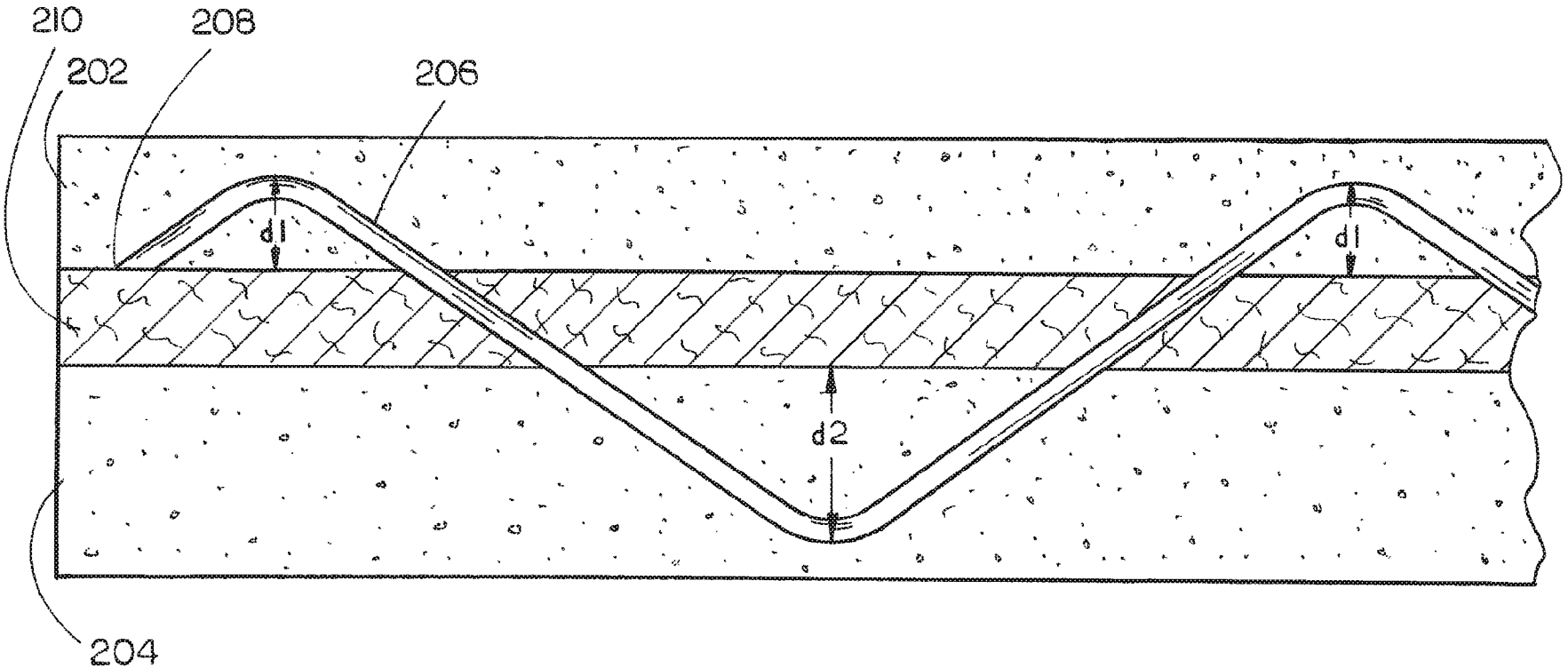
FIG. 14 is a partial cross-section side view of a sandwich panel having concrete panels of different thicknesses.
Figure 15:
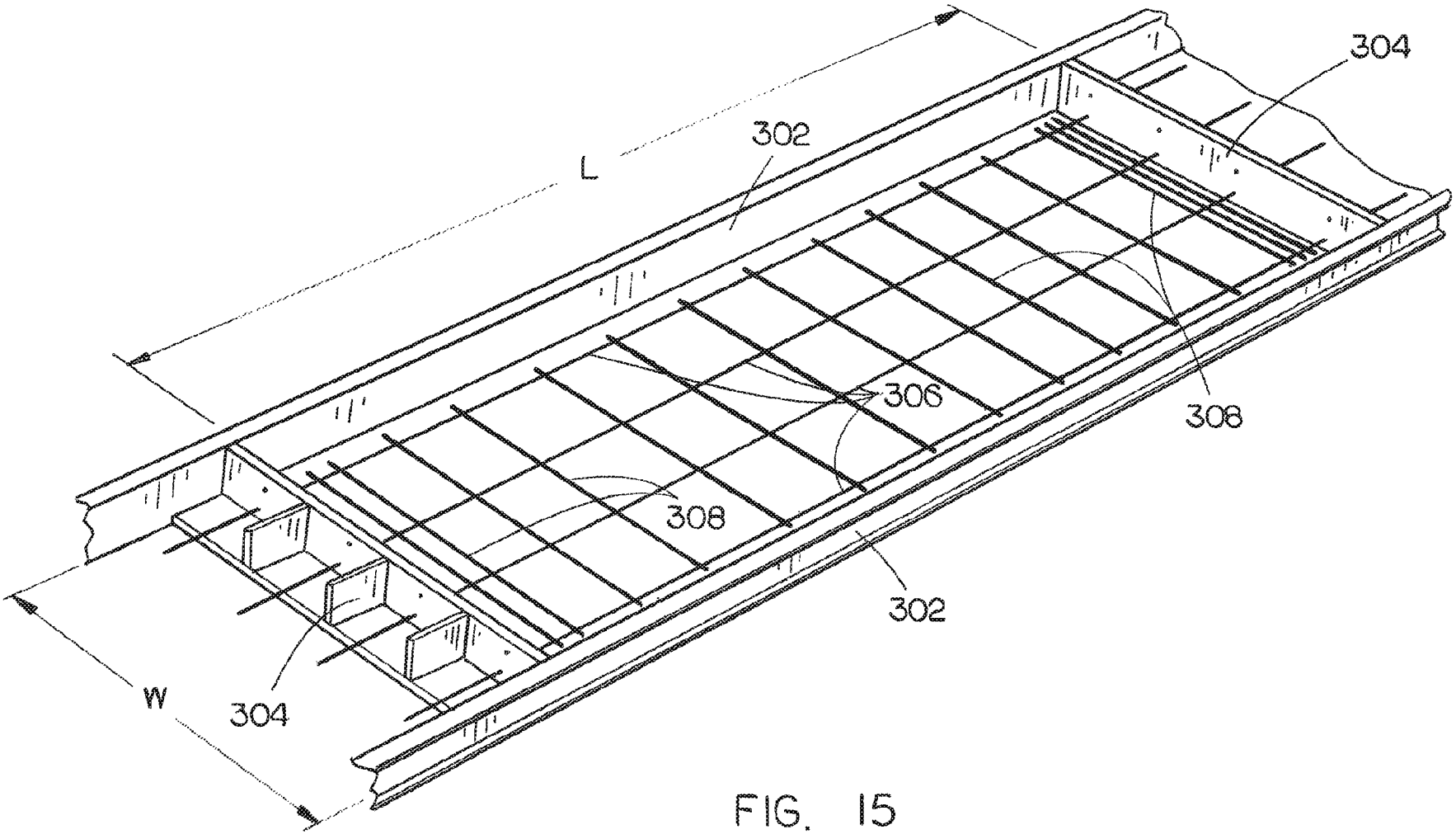
FIG. 15 is a partial isometric view of a panel forming system, wherein the reinforcement installation of the first layer of concrete is installed.

However, if the application requires the thickness of one concrete panel to be different from the thickness of another, the distances d1 and d2 may also differ accordingly. In an example depicted in FIG. 14, a first concrete panel 202 may have a first thickness that is less than a second thickness of a second concrete panel 204. In such cases, the tie 206 may be inserted into the insulation panel 210 so that the distance d1 is less than the distance d2. The ends 208 of the tie 206 may be configured for providing the self-positioning feature as previously described. While it is understood that the specific values for the distances d1 and d2 may be determined for each particular application, it may be desirable for the peaks of the ties to be embedded into the respective concrete panels as much as possible without infringing the outer surfaces of the concrete panels.

Referring generally to FIGS. 15 through 21, a method/process for constructing a concrete sandwich panel in accordance with the present disclosure is shown. In one embodiment, the concrete sandwich panel is formed on a generally planar panel forming system (may be referred to as bed). The panel forming system may include two slidable side members 302 for defining the width w of the sandwich panel and two slidable head members 304 for defining the length l of the sandwich panel. The height of the side members 302 and the head members 304 may be adjusted according to the desired thickness of the sandwich panel. The side members 302 may be elongated and additional head members may be positioned between the side members for defining additional forms for forming sandwich panels.

Once the dimension of the sandwich panel is configured, a first reinforcement installation may be installed. The first reinforcement installation may include twisting moment resisting means such as one or more reinforcing bars (rebars) 308. In addition, the reinforcement installations may also include tensile strength imparting means such as one or more prestressed cables 306. In one embodiment, the prestressed cables 306 are oriented in a direction generally parallel to the side members 302, and are prestressed to at least 16,800 lbs of pressure. Rebars 308 having diameters of at least ⅜ of an inch (a.k.a. #3 rebar) may be oriented in a direction generally perpendicular to the side members 304. It is understood that handling inserts (inserts at the side of the sandwich panel utilized for lifting) and/or plate inserts (inserts for attachment of roof/floor elements) may also be configured per specification of the sandwich panel without departing from the scope of the present disclosure.

Figure 16:
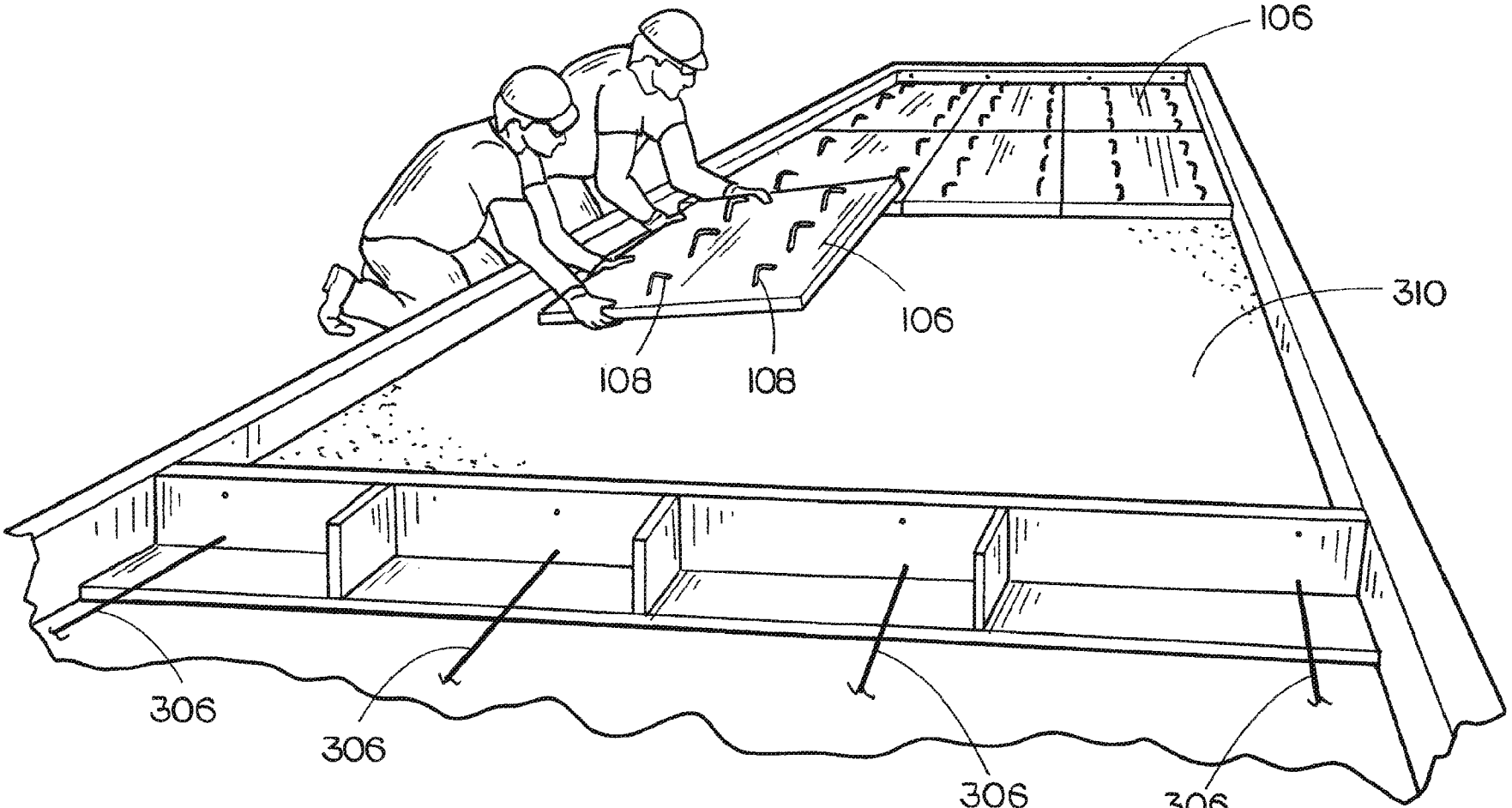
FIG. 16 is an isometric view illustrating the placement of the insulating panels with ties.
Figure 17:
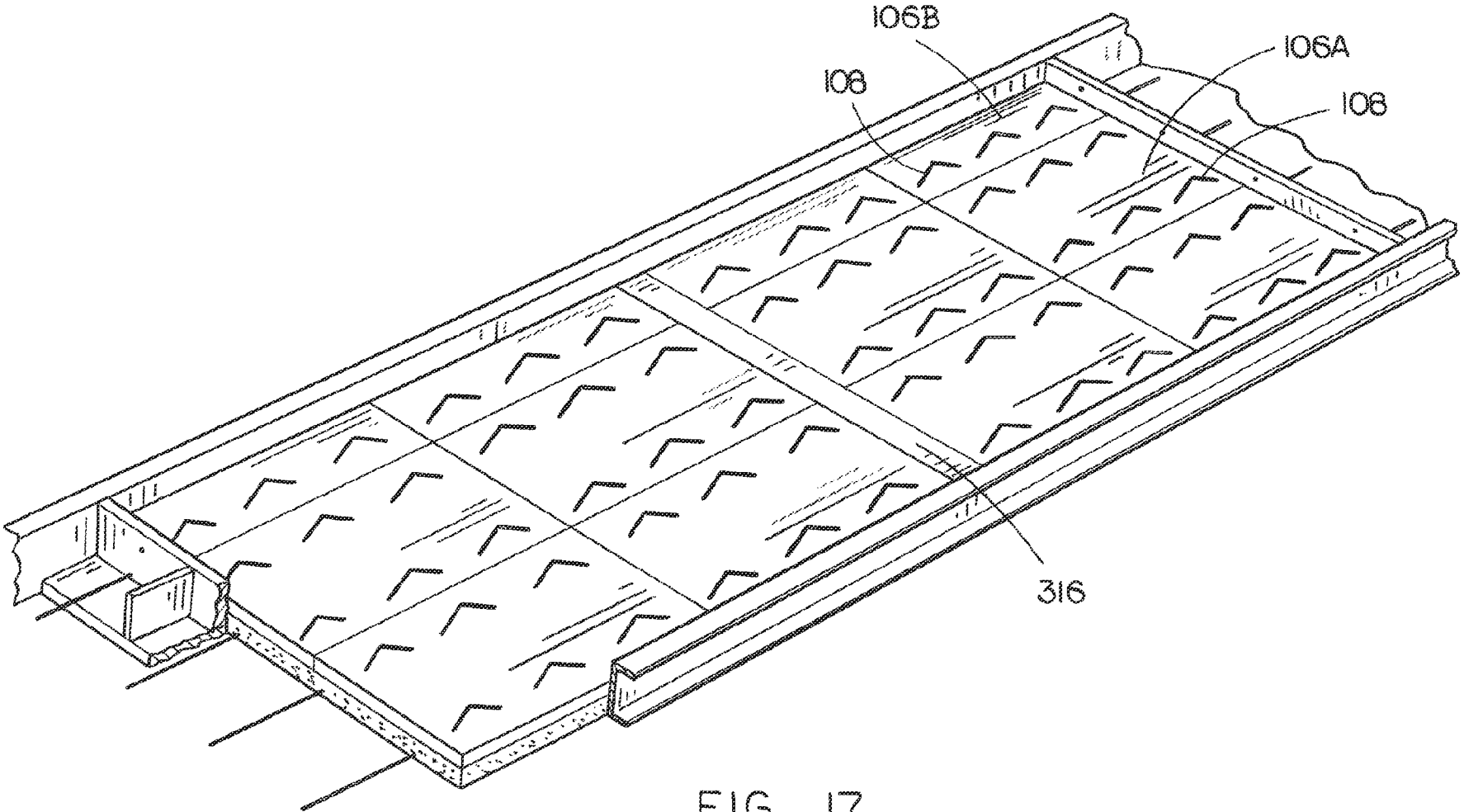
FIG. 17 is a partial isometric view of the panel forming system, wherein the insulating layer is installed.
Figure 18:
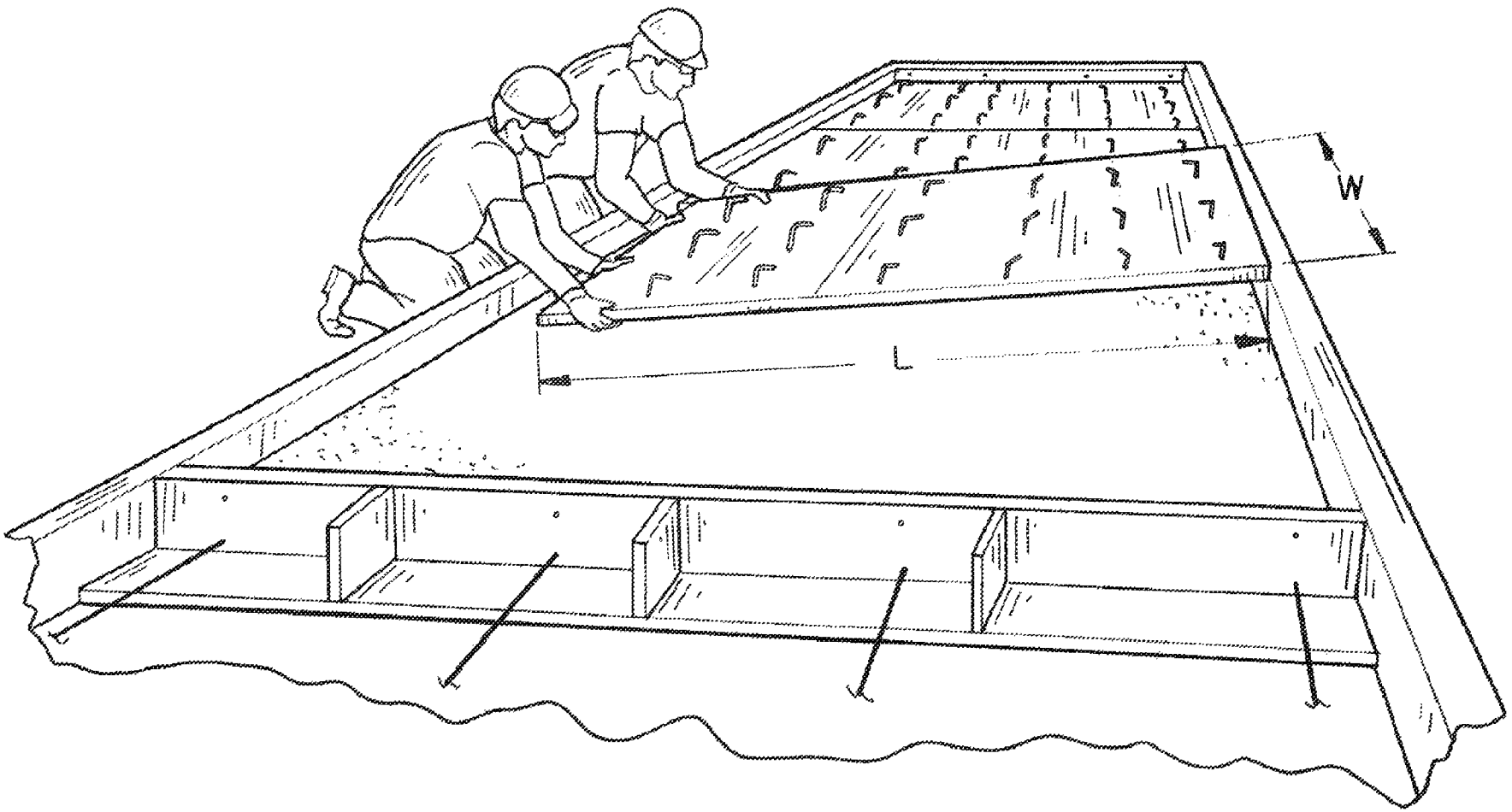
FIG. 18 is another isometric view illustrating the placement of the insulating panels with ties.
Figure 19:
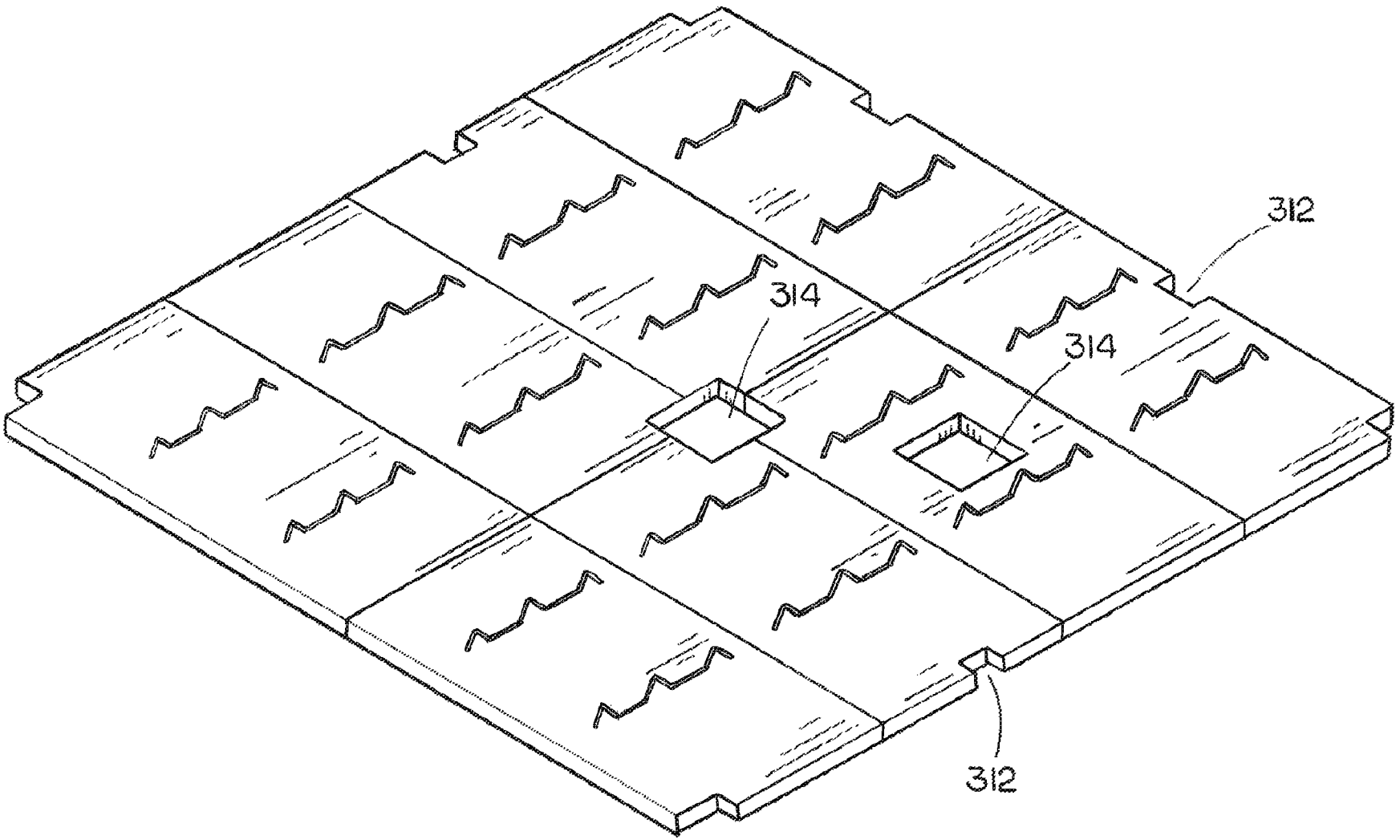
FIG. 19 is an isometric view illustrating a cut out area defined by the insulating panels.

Once the first reinforcement installation is configured, concrete mix may be poured into the panel forming bed to form a first reinforced concrete panel 310 having the first reinforcement installation embedded within. Subsequently, as illustrated in FIG. 16, insulating panels 106 with ties 108 inserted (as previously described) may be placed on top of the first reinforced concrete panel 310 before the first reinforced concrete panel 310 hardens (e.g., may be placed immediately after forming the concrete panel 310). The insulating panels 106 may be pushed into the first concrete panel 310 and are stopped by the elevation of the first concrete panel 310. In this manner, the bottom surfaces of the insulating panels 106 touches the first reinforced concrete panel 310, and the portions of the ties underneath the insulating panels 106 are embedded into the first reinforced concrete panel 310 for joining the insulating panels 106 to the first reinforced concrete panel 310.

Depending on the desired dimension of the sandwich panel, the insulating panels placed on top of the first concrete panel 310 may not be uniformly sized. In an example illustrated in FIG. 17, the desired width of the sandwich panel may require two insulating panels 106A of a first size and an insulating panel 106B of a second size. In another example, the desired length of the sandwich panel may be indivisible by the length of the insulating panel, therefore, insulating panels having a different geometric configuration may be utilized for filling the remaining spaces (may be referred to as spacers 316).

Alternatively, the dimensions of the insulating panels may be pre-configured (e.g., custom made or configured) based on the desired dimension of the sandwich panel. In an example illustrated in FIG. 18, the dimension of the insulating panels may be configured based on the width of the sandwich panel. For instance, the insulating panels may be configured as a rectangular board of 4'-0" wide by the width of the sandwich panel, is allowing such insulating panels to be placed on top of the first concrete panel 310 without further adjusting the lengths of the insulating panels. It is understood that both the widths and/or lengths of the insulating panels may be pre-configured based on the desired dimension of the sandwich panel.

The number of ties 108 inserted into each insulating panel may vary. For example, depending on the locations of the insulating panels placed in the sandwich panel, certain insulating panels may include multiple ties while some insulating panels may not include any tie. In one instance, the ties may be substantially uniformly distributed with respect to both the width and the length of the sandwich panel. In another instance, the ties may be more concentrated at certain portions of the of sandwich panel (e.g., towards the ends of the sandwich panel).

Furthermore, depending on the design of the sandwich panel, certain portions of the insulating panels may be cut out to accommodate for elements that are inserted and/or attached to the sandwich panel. In an example illustrated in FIG. 19, insulating panels located along the edge of the sandwich panel may define cut out areas 312 to accommodate for handling inserts configured at the side of the sandwich panel. In another example, cut out areas 314 may be desirable to accommodate for elements such as windows which may be attached to the sandwich panel at a later time. It is understood that the insulating panels may be precut based on the specifications/designs of the sandwich panels.

Figure 20:
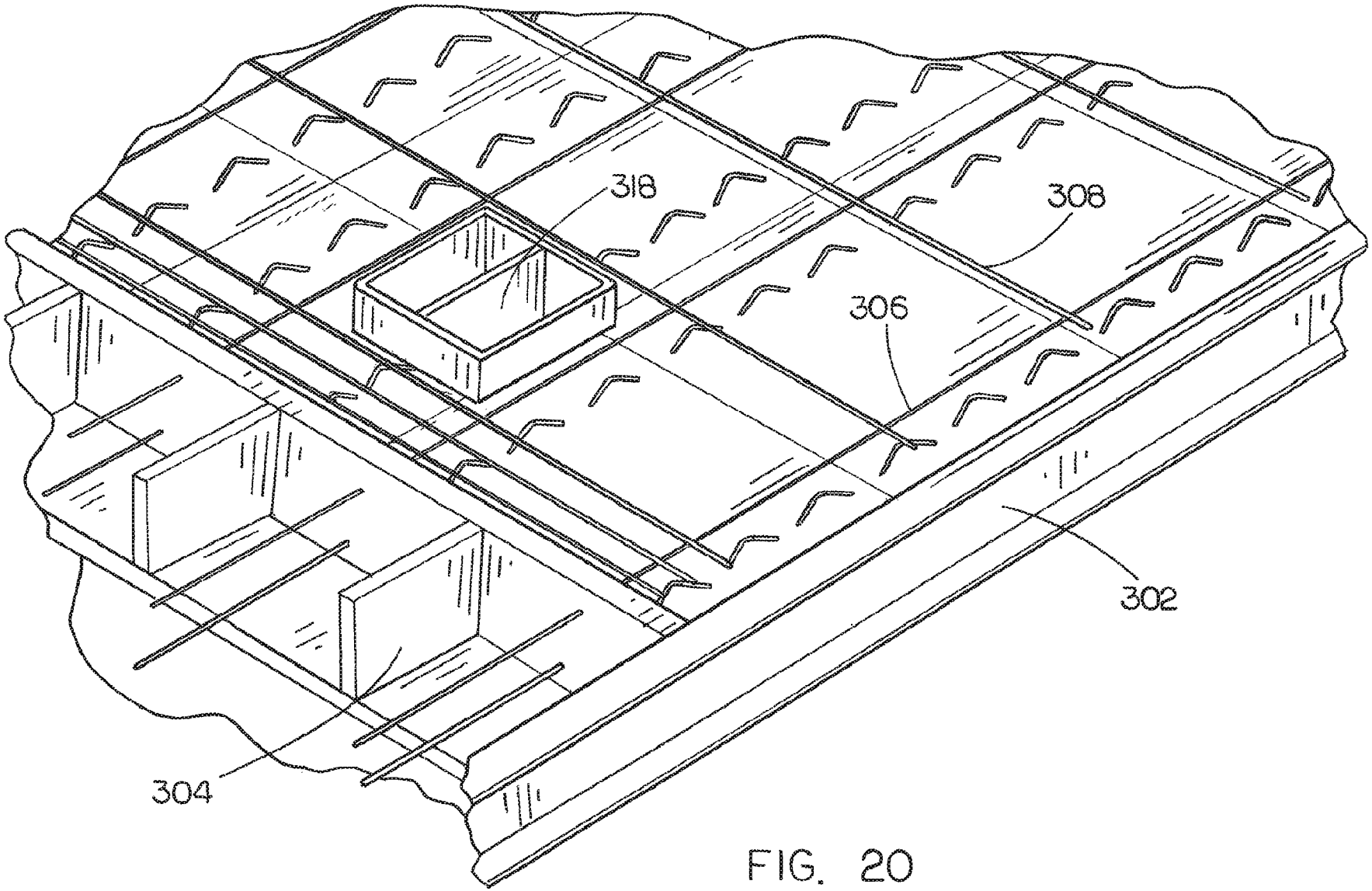
FIG. 20 is a partial isometric view of the panel forming system, wherein the reinforcement installation of the second layer of concrete is installed.

Once all of the insulating panels (and necessary spacers) have been placed on top of the reinforced concrete panel 310, a second reinforcement installation may be installed above the insulating panels. FIG. 20 depicts an exemplary second reinforcement installation. Similar to the first reinforcement installation, the second reinforcement installation may also include twisting moment resisting means such as one or more reinforcing bars (rebars) 308 and/or tensile strength imparting means such as one or more prestressed cables 306. Elements for securing handling inserts and the like, if included in the sandwich panel, may also be placed on top of the insulating panels.

Also illustrated in FIG. 20 is a placeholder 318 for receiving a window in the sandwich panel. Such placeholders may be placed in the panel forming system prior to forming the first concrete panel 310, forcing the concrete to form around the placeholder 318. The insulating panels may be configured to define cut out areas around the placeholder 318 as previously described. It is contemplated that placeholders of various shapes and forms may be configured without departing from the scope of the present disclosure.

Figure 21:
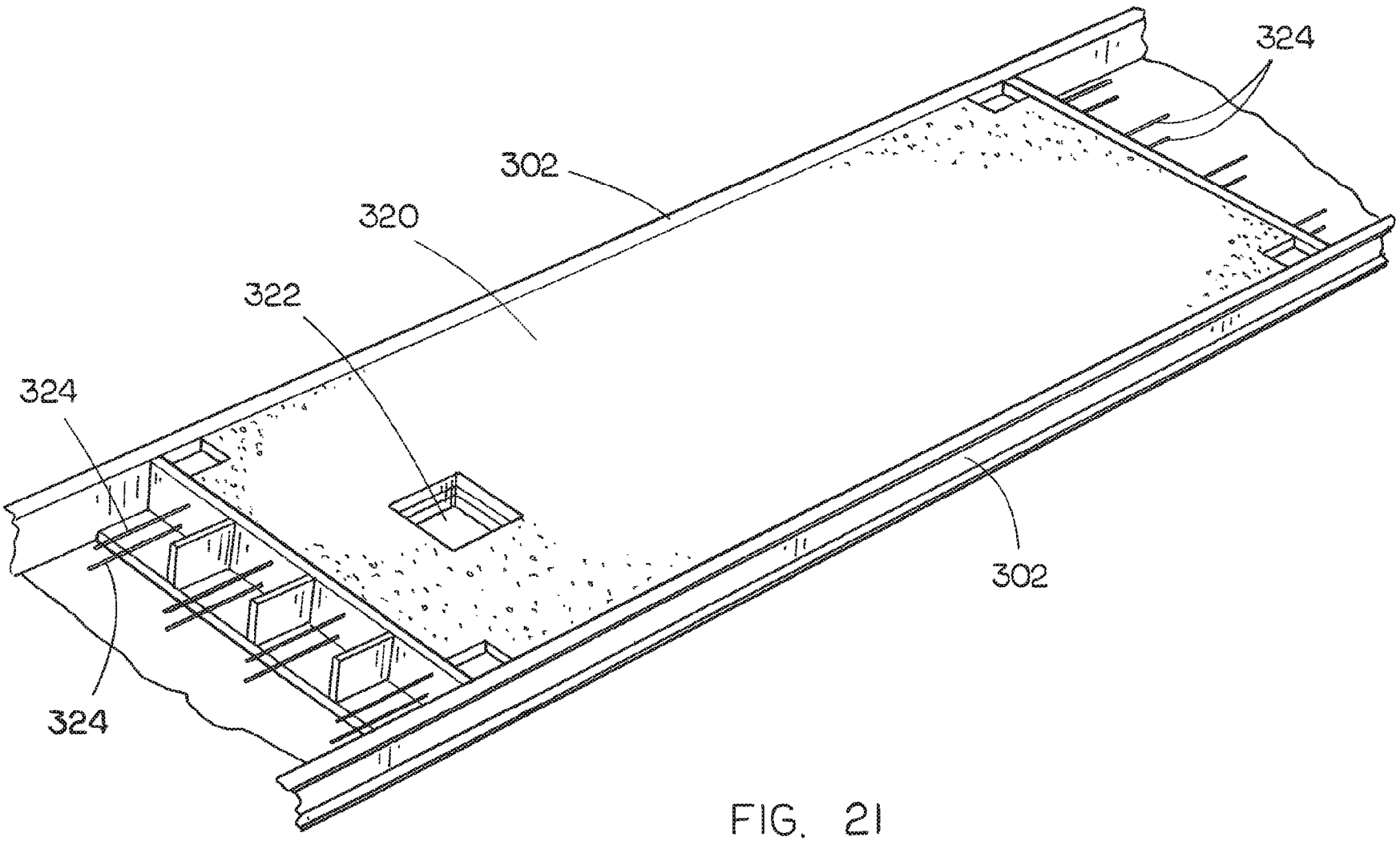
FIG. 21 is a partial isometric view of the panel forming system, wherein the second layer of concrete is poured.

As illustrated in FIG. 21, once the second reinforcement installation is configured, concrete mix may be poured into the panel forming bed on top of the insulating panels to form a second reinforced concrete panel 320 having the second reinforcement installation embedded within. In the example depicted in FIG. 21, if a placeholder is positioned in the panel forming system, the second reinforced concrete panel 320 may form around the placeholder. In this manner, the resulting sandwich panel may define an opening 322 (through all three layers) around the placeholder for receiving attachments (e.g., windows, door, etc.) at a later time.

The sandwich panel may remain in the panel forming system for at least a predetermined amount of time (e.g., a day) for the reinforced concrete panels 310 and 320 to harden. After the predetermined amount of time, portions of the prestressed cables 324 not embedded within the reinforced concrete panels 310 and 320 may be detached, and the sandwich panel may be removed from the panel forming system (e.g., utilizing a vacuum system) to be transported to a location where the sandwich panel may be completely cured. The panel forming system may be configured for forming the next group of sandwich panels.

Figure 22:
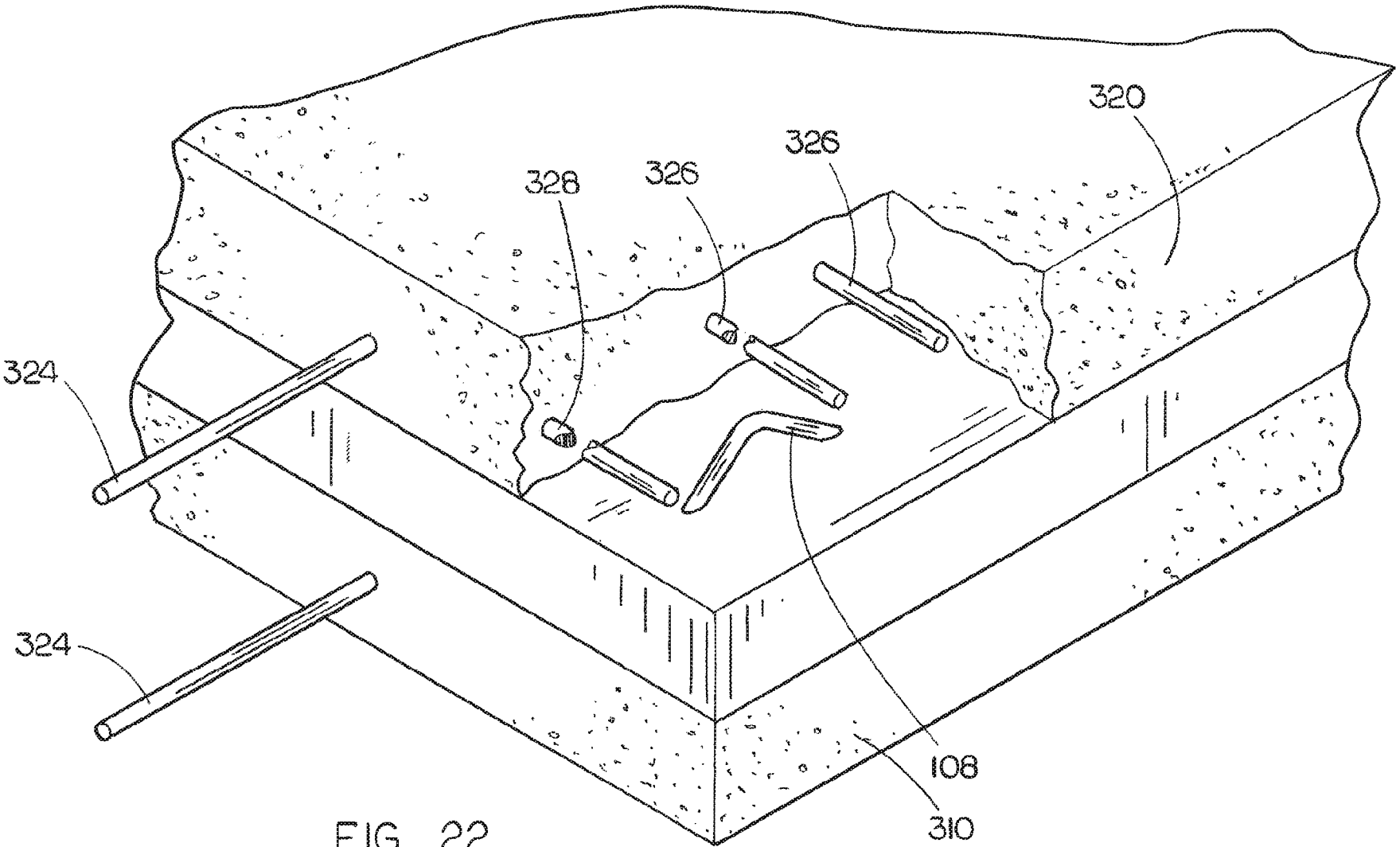
FIG. 22 is a partial isometric view of the sandwich panel illustrating a composite bar utilized for reinforcement the edge of the panel.
Figure 23:
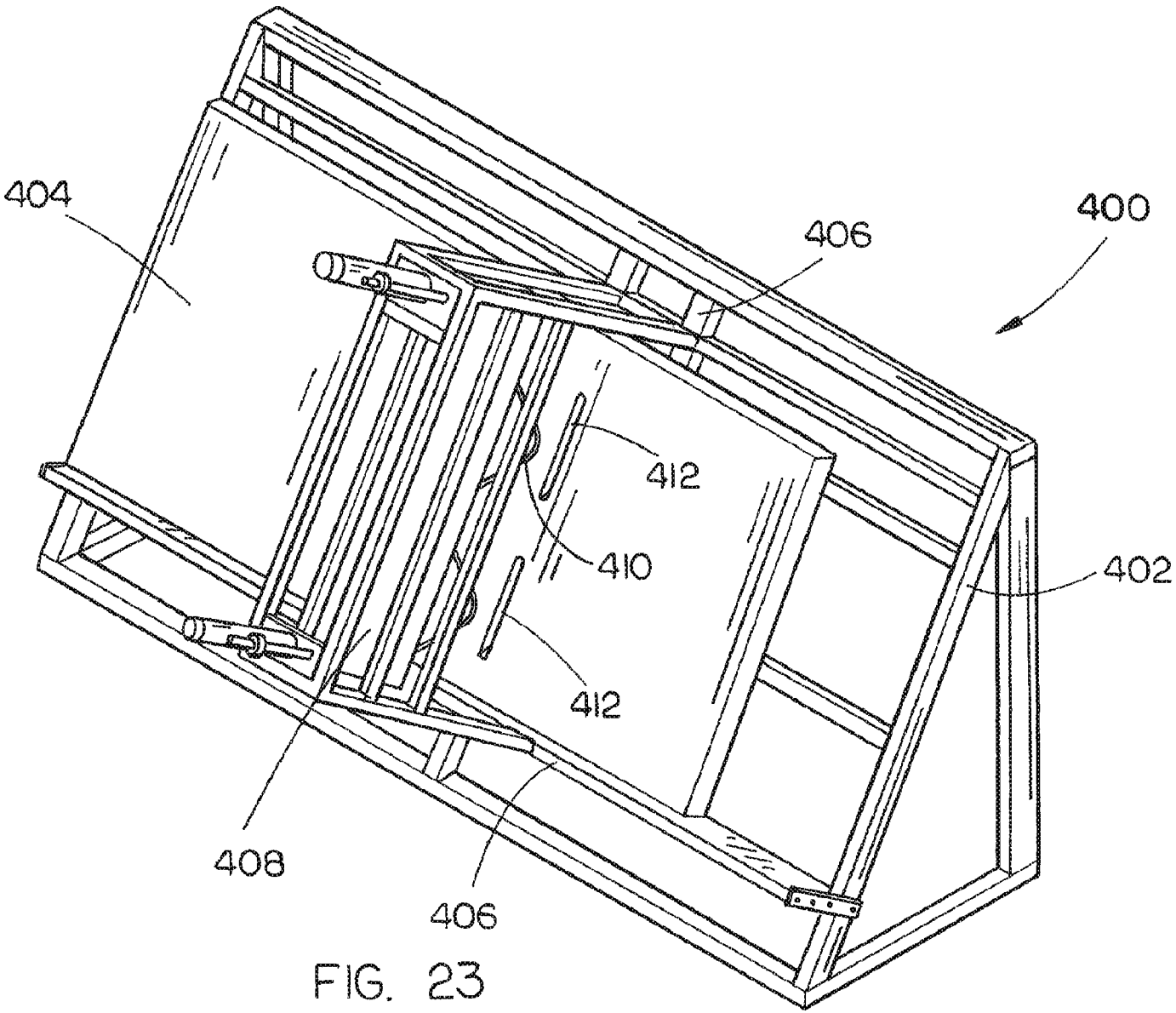
FIG. 23 is an isometric view of a slot melting apparatus.
Figure 24:
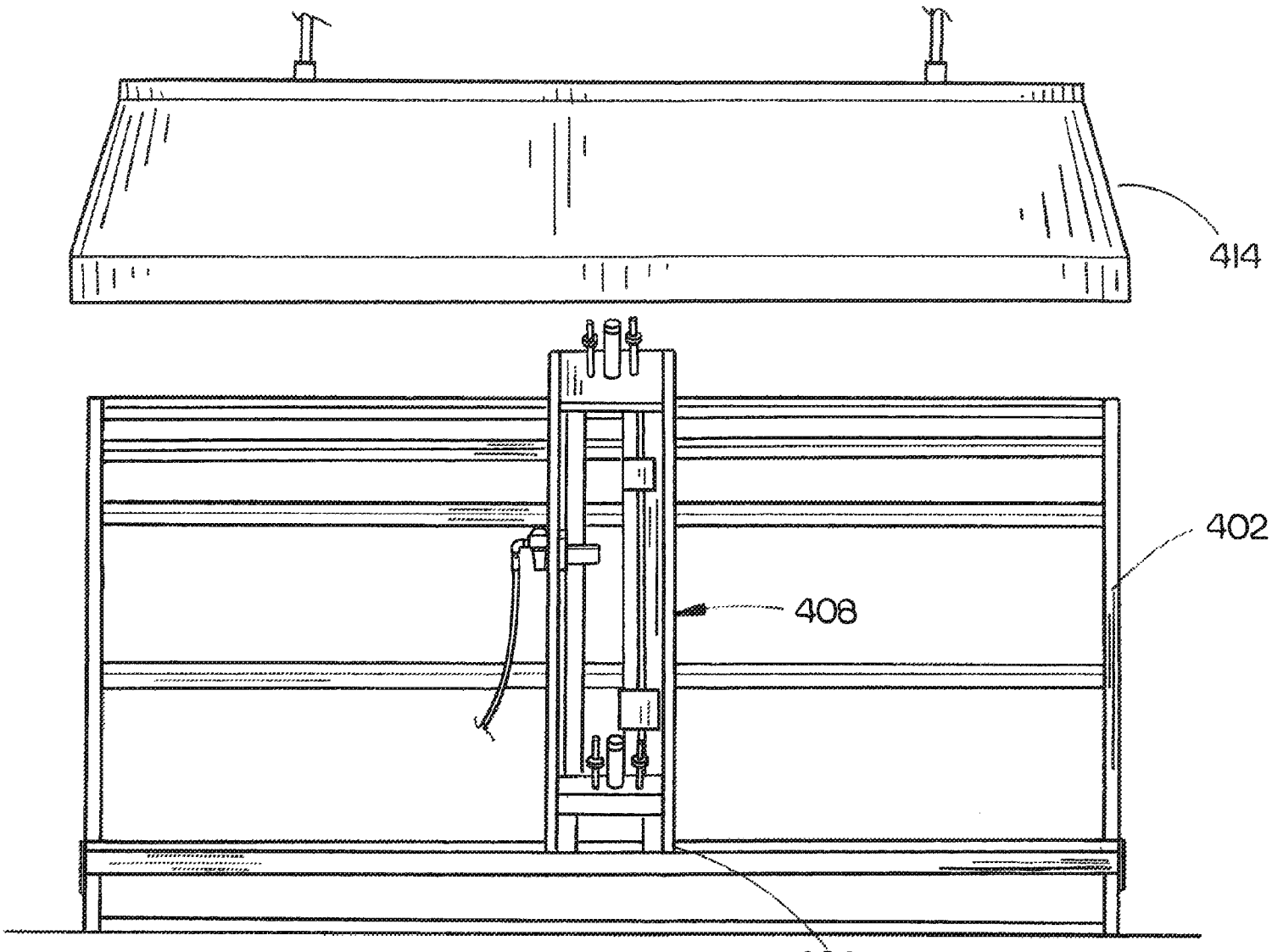
FIG. 24 is a front view of the slot melting apparatus.
Figure 25:
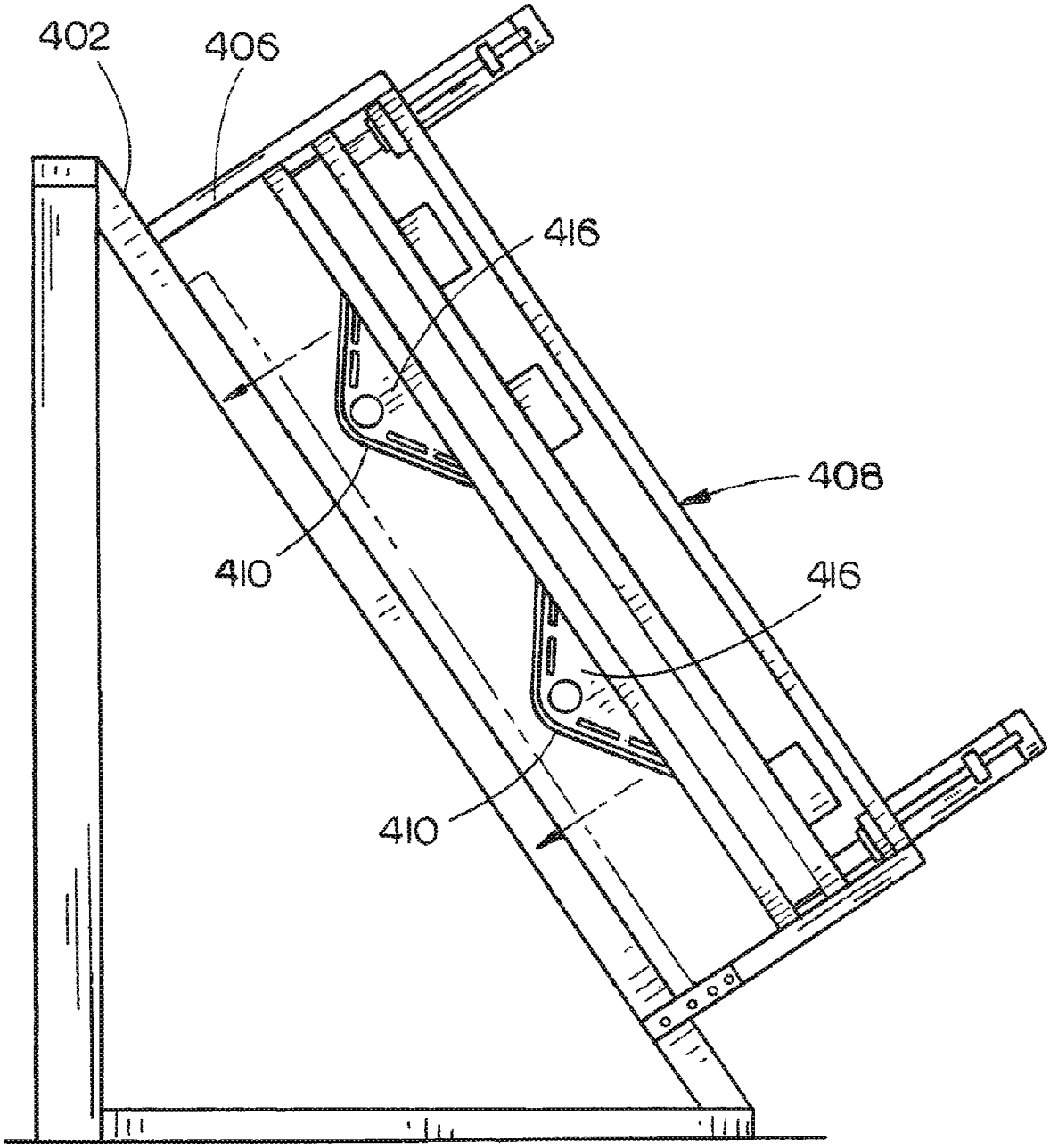
FIG. 25 is a side view of the slot melting apparatus.

It is understood that the forces released when detaching the portions of the prestressed cables 324 not embedded within the reinforced concrete panels 310 and 320 may damage the edges of the panels that are perpendicular to the prestressed cables. In one embodiment, as illustrated in FIG. 22, a composite bar 328 may be placed along the edges to provide reinforcement to the concrete. The composite bars 328 may be positioned on the same horizontal planes as the regular (steel) rebars 326 that form the reinforcement installations of the concrete panels. However, the composite bars 328 may be positioned much closer to the edges of concrete panels where the regular rebars 326 may not be suitable. In one example, the composite bars 328 utilizes composite materials including fiber glass, and may be configured to have the same shape and form as the regular rebars 326.

It is contemplated that the panel forming system may utilize vibrations to reduce the amount of air pockets in the concrete panels. In one embodiment, as the concrete panel is poured from one end to the opposite end along the length of the panel, one or more vibrators may be set at the starting point of the pour and vibrates (e.g., vibrates at 78 db and runs at 6000 vpm) till the halfway point of the panel is reached. The vibrators may then be relocated to the opposite end of the panel and vibrates for the remainder of the pour. It is understood that the vibrations may be applied only during pouring of one panel (e.g., only to the formed face which eventually becomes the exterior face of the wall). It is also understood that other vibration techniques and air pockets reducing techniques may be utilized as well.

It is also contemplated that self-consolidating concrete may be utilized to form the concrete panels. Self-consolidating concrete may attach itself to the panel forming system that it is being casted against, effectively reducing the number of air pockets without the need for vibration. It is further contemplated that the panel forming system may also include engravings and the like which may form design patterns to the outer surfaces of the concrete panels.

While the sandwich panels illustrated in the exemplary embodiments above are generally rectangular, it is understood that sandwich panels of different shapes and forms (e.g., triangular or circular shaped sandwich panels) may be manufactured utilizing the method of the present disclosure.

Referring generally to FIGS. 23 through 28, a slotting apparatus 400 for creating slots configured for receiving the ties in the insulating panels is shown. The slotting apparatus 400 comprises a frame 402 for supporting for an insulating board 404. In one embodiment, the frame 402 may be configured as an easel type fixture defining a plane for supporting the insulating board 404.

The slotting apparatus 400 also comprises a track 406 slidably connected to the frame 402 for translating in a direction generally parallel to the frame 402, and a slotting element 408 slidably connected to the track 406 for translating in a direction generally perpendicular to the frame 402. The slotting element 408 may include a heating member 410 configured for plunging into the insulating board 404 to create a plurality of slots 412 to accommodate the ties previously described. An overhead bin 414 may also be utilized for providing lighting and/or ventilation during the operation of the slotting apparatus 400.

Figure 26:
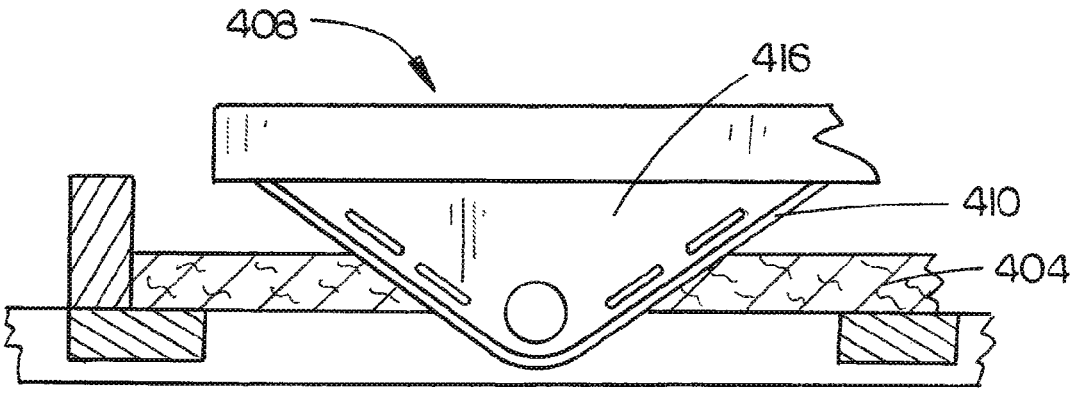
FIG. 26 is a partial side view of the slot melting apparatus in operation.
Figure 27:
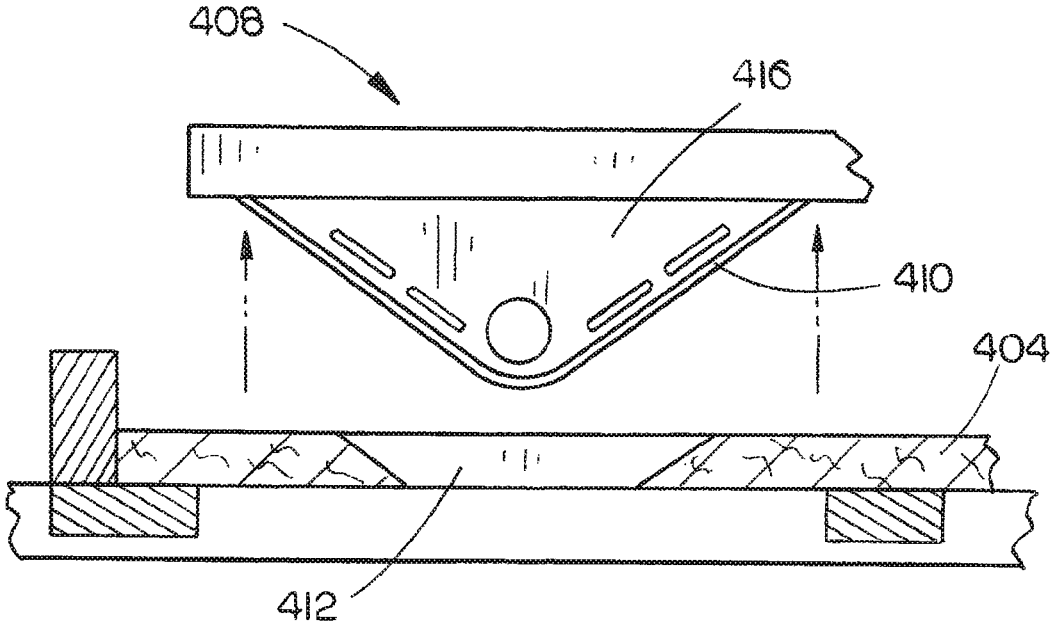
FIG. 27 is another partial side view of the slot melting apparatus in operation.

In one embodiment, the slotting element 408 may include a plurality of air powered cylinders and valves configured for providing location and time control of the heating member 410. The heating member 410 may include one or more alloy heating element (e.g., tungsten or beryllium rod/wire) supported by a plate 416. During the operation, the alloy heating element may be electrically heated to a temperature in excess of a melting temperature of Styrofoam. As illustrated in FIGS. 26 and 27, at least a portion of the heating member 410 may be plunged into the insulating panel 404 and the alloy heating element may melt certain portions of the insulating panel 404 to create desired slots 412. Once the desired slots 412 are created, the air powered cylinders and valves may lift the heating member 410 away from the insulating panel 404.

Figure 28:
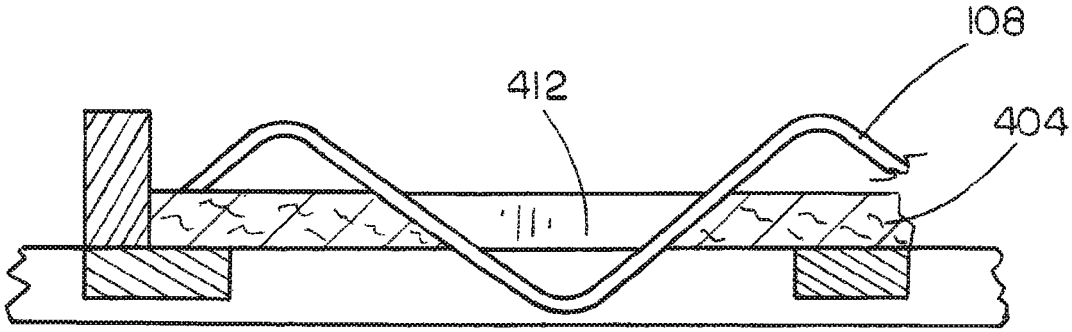
FIG. 28 is a partial side view depicting the slot melted utilizing the slot melting apparatus.

Referring to FIGS. 6, 7, 27 and 28, the slots for receiving the ties may be generally perpendicular to the upper surface of the insulating panel. The slots may be generally planar and parallel with respect to a longitudinal axis l of the insulating panel. Furthermore, the cross-sectional profile of the slots along the longitudinal axis l of the insulating panel may have a partially generally triangle wave-shaped pattern 412 as illustrated in FIGS. 27 and 28. The partially generally triangle wave-shaped pattern of the slots is so configured for receiving the ties 108, which has a generally triangle wave-shaped pattern.

Figure 29:
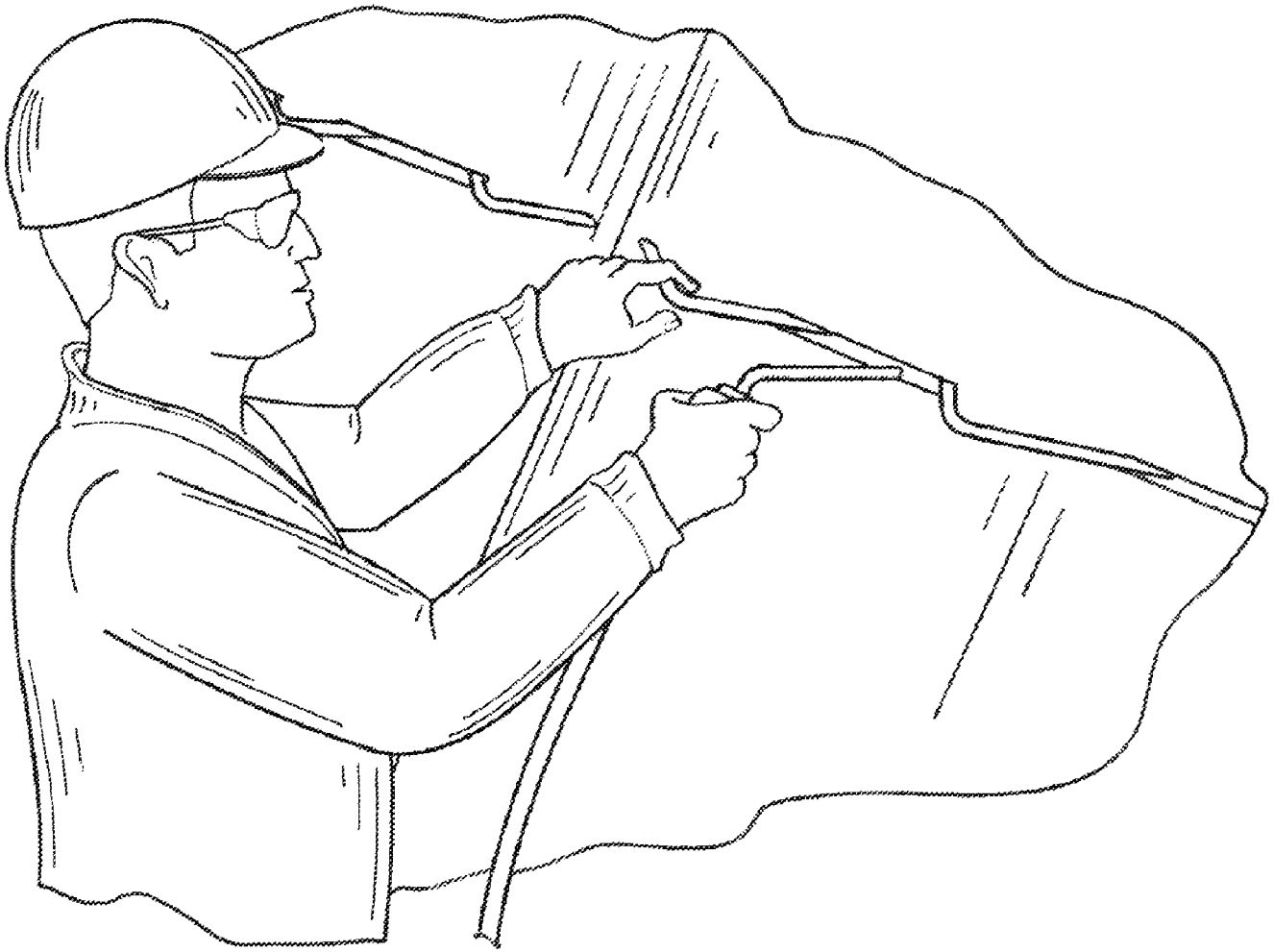
FIG. 29 is an illustration of sealing the slot upon insertion of a tie.

The ties 108 may be inserted into the insulating panels at the slots such that opposing ends of the tie terminate adjacent to the insulating panel. In addition, as depicted in FIG. 29, insulating materials may be utilized to fill/seal the slots upon insertion of the ties 108 to prevent/reduce thermal bridging through such slots. For example, an insulating foam sealant may be applied to the slots manually. Excessive amount of insulating materials applied, if any, may be removed (e.g., utilizing a saw or a blade). In another example, a measured amount of sealant may be applied to the slots automatically.

Figure 30:
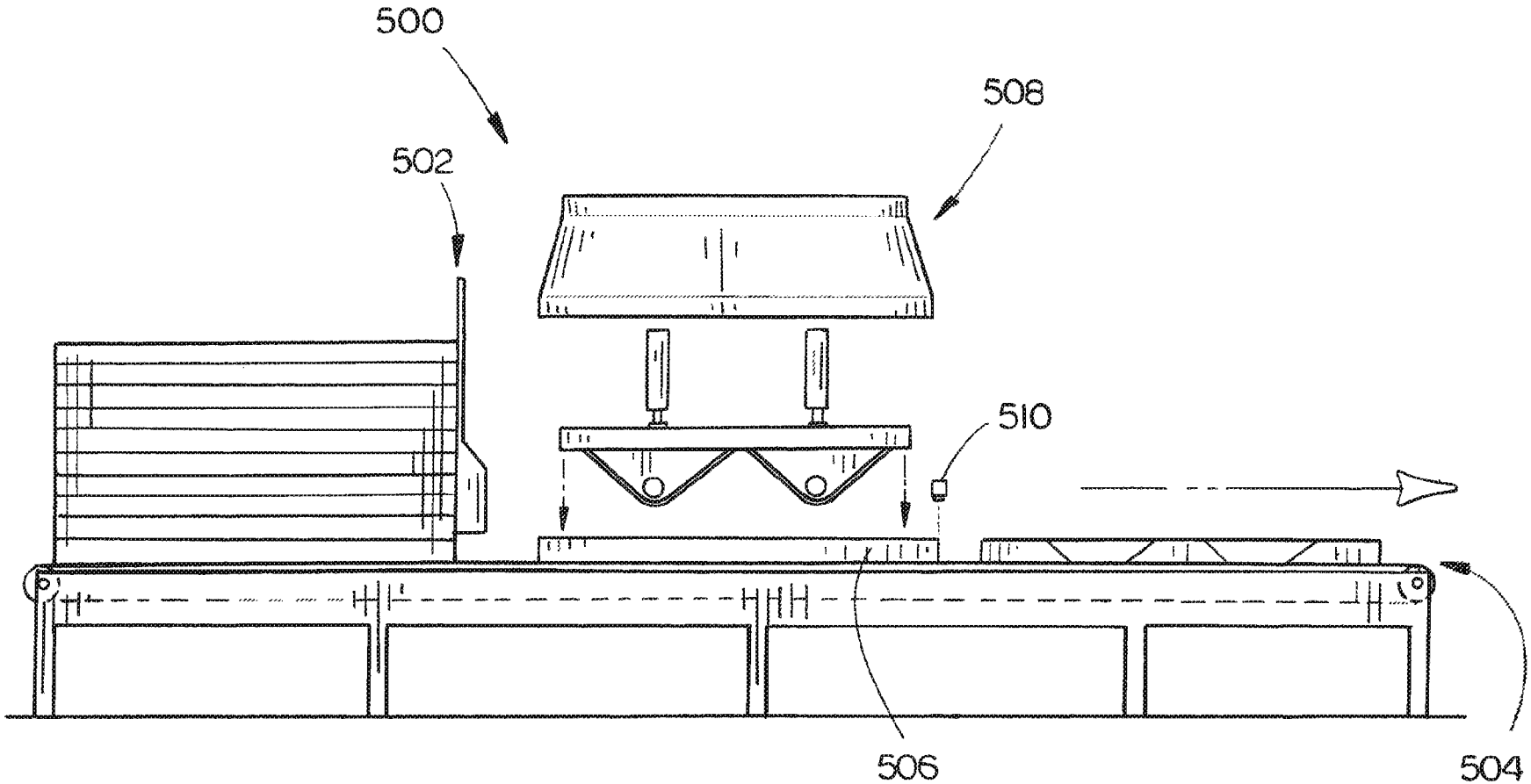
FIG. 30 is a partial front view of an automated slot melting system.
Figure 31:
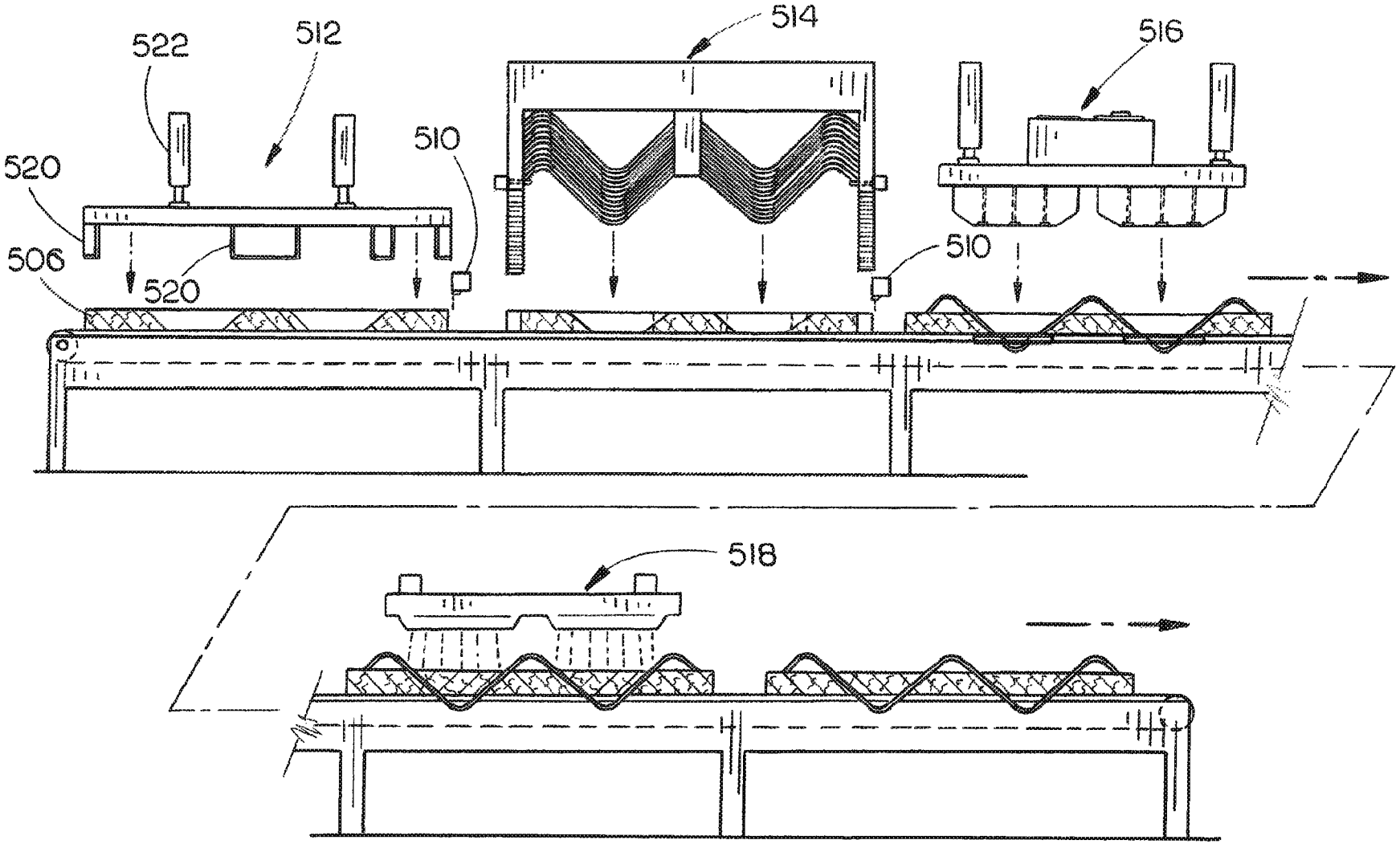
FIG. 31 is another partial front view of the automated slot melting system.

Referring generally to FIGS. 30 and 31, an automated system 500 for preparing insulating panels in accordance with the present disclosure is shown. In one embodiment, the automated system 500 may comprise a device 502 for holding a plurality of insulating boards/panels. For example, the holding device 502 may include a container for holding the insulating boards in the same orientation. The holding device 502 may be configured for providing one insulating board 506 at a time to a conveyer system 504.

The conveyer system 504 may transport the insulating board 506 to a subsequent device 508 for creating one or more slots in the insulating board 506. The slotting device 508 may be configured similarly to the slotting apparatus previously described. In addition, the slotting device 508 may be configured to receive electronic information specifying the exact locations of which the slots may be needed. Such information may be predetermined based on the specifications and/or designs of the sandwich panel and transmitted to the slotting device 508 via a control terminal (e.g., a computer system). It is understood that one or more sensors 510 may be utilized to facilitate positioning of the slotting device 508 with respect to the insulating board 506 to achieve desired precisions.

Since the dimensions of the sandwich panels may vary, certain is insulating boards may need to be readjusted (cut) to fit the specific dimension requirements. The automated system 500 may include a cutting device 512 for cutting the insulating board 506 to a specified configuration. For example, given a required dimension of a sandwich panel, the number of insulating boards needed to form the insulating layer of the sandwich panel may be determined. In addition, the insulating boards that need to be readjusted may be identified. Such information may be transmitted electronically to the cutting device 512, which may cut the insulating boards accordingly.

The cutting device 512 may comprise one or more movable cutting apparatus 520 (e.g., blades or tungsten wires) actuated by air powered cylinders and valves 522. One or more sensors 510 may also be utilized to facilitate positioning of the cutting apparatus 520 with respect to the insulating board to achieve desired precisions.

In one embodiment, the electronic information provided to the cutting device 512 may specify a particular cutting order. For example, the cutting device 512 may cut the insulating boards in accordance with the order of which these insulating boards are installed. In another example, a labeling device may be utilized to label the insulating boards based on their corresponding orders. Such labels may help workers to identify the insulating boards during the installation process. It is understood that certain insulating boards may not need cutting, in such cases, these insulating boards may pass through the cutting device 512.

The automated system 500 may further include a tie inserting device 514 configured for inserting ties into the insulating boards. The tie inserting device 514 may utilize one or more sensors 510 to align the ties with the slots in the insulating boards. It is contemplated that the tie inserting device 514 may be configured for holding ties having different peak-to-peak amplitudes. The sensors 510 may determine the thickness of the insulating board, and the tie inserting device 514 may select a tie having appropriate peak-to-peak amplitude based on the thickness of the insulating board and insert the selected tie into the insulting board.

The automated system 500 may also include an injecting device 516 configured for injecting a predetermined amount of insulating material into the slots of the insulting board upon insertion of the tie. In addition, a curing device 518 may be utilized to quickly cure the insulating material injected into the slots. For example, the curing device 518 may include a heat source and/or an ultraviolet light source for curing. The insulating boards with ties inserted may be removed from the automated system 500 (e.g., utilizing a vacuum lift) and delivered to the sandwich panel manufacturing area.

Figure 32:
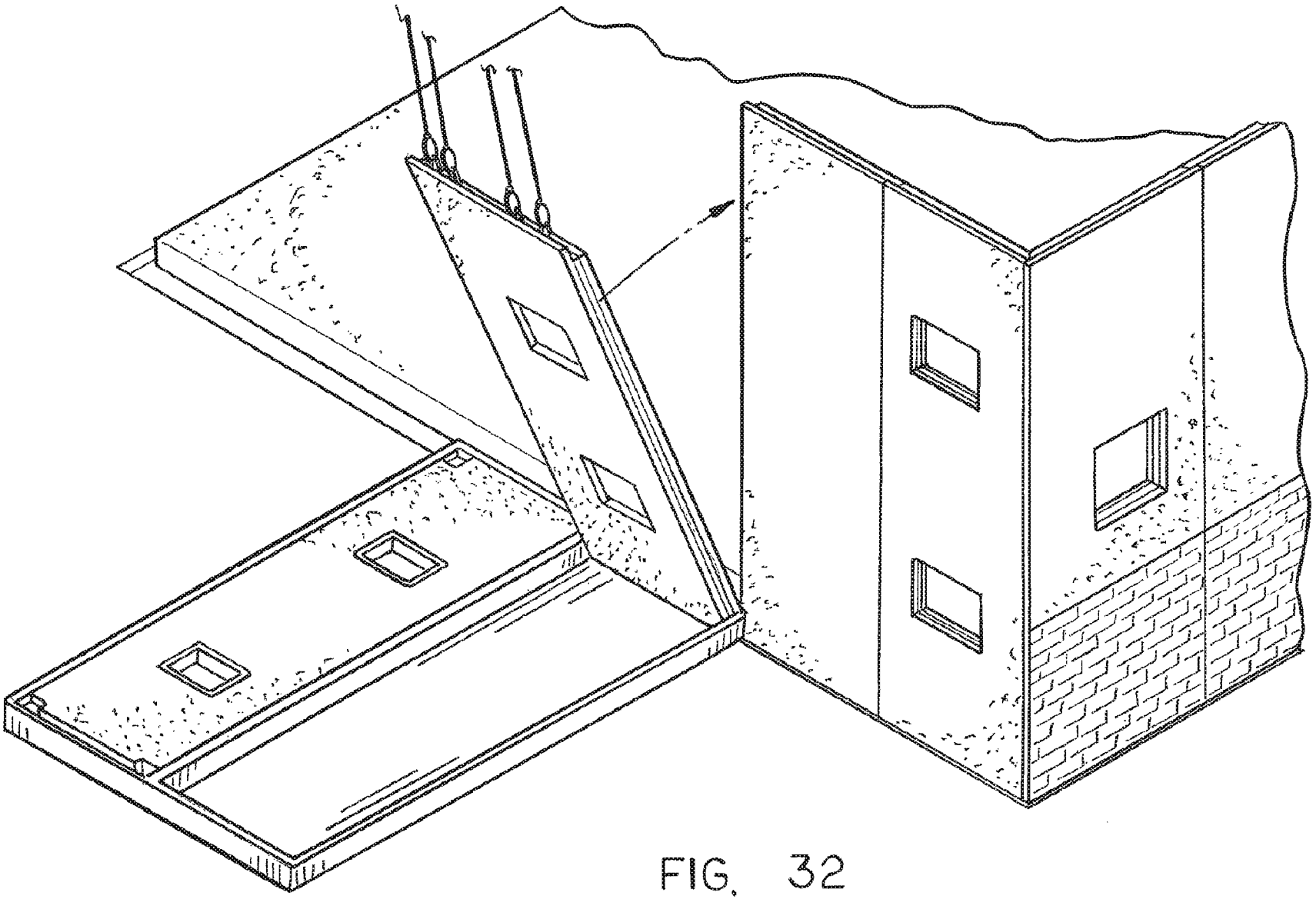
FIG. 32 is an illustration of a tilt-up construction utilizing a concrete sandwich panel.

It is contemplated that the method for constructing a concrete sandwich panel in accordance with the present disclosure may be utilized at the construction sites. FIG. 32 depicts a tilt-up construction method which may utilize the sandwich panel constructing method of the present disclose at the construction site. The sandwich panel produced may then be tilted up to a desired position for the construction job.

Figure 33:
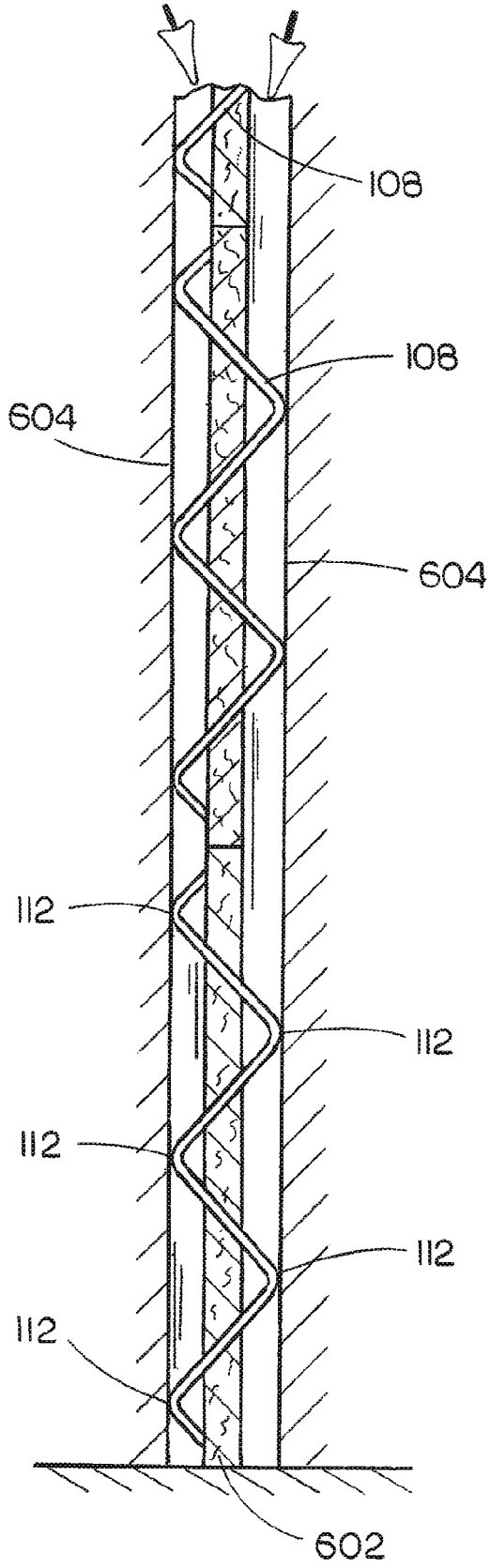
FIG. 33 is a side view of a form with insulating panels inserted wherein the peaks of the ties are abutting against the sides of the form.
Figure 34:
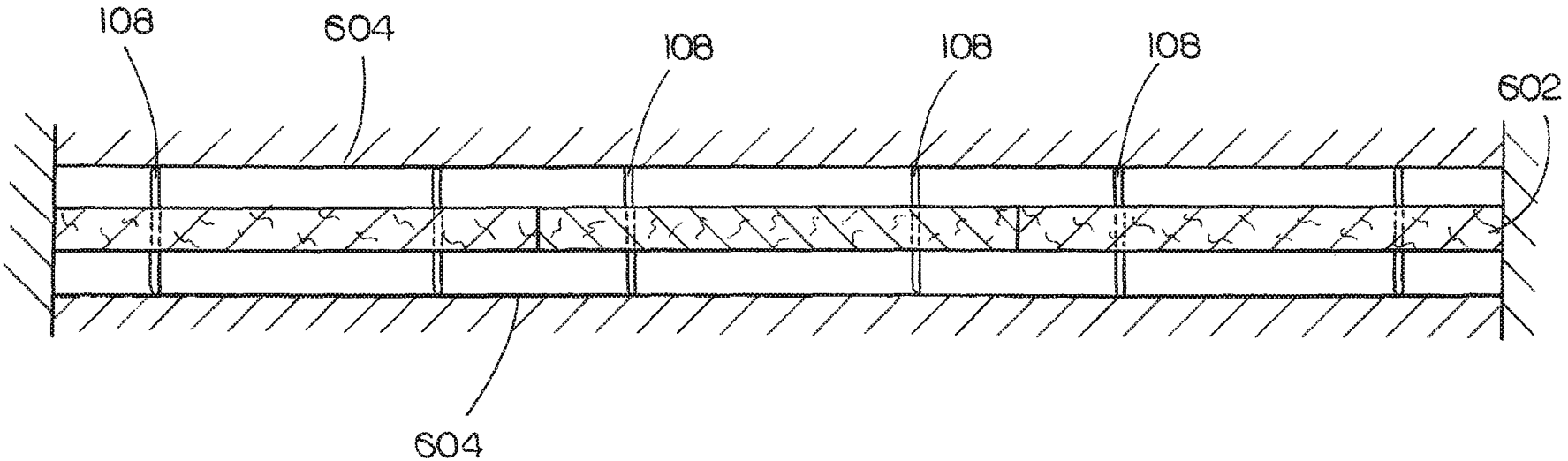
FIG. 34 is a top view of the form with insulating panels inserted wherein the peaks of the ties are abutting against the sides of the form.

It is also contemplated that the insulating panels with ties inserted in accordance with the present disclosure may be appreciated in certain cast-in-place applications. Referring to FIGS. 33 and 34, in certain cast-in-place applications such as foundation wall applications, the insulating panels 602 with ties 108 inserted may be positioned in the form of the foundation wall where the peaks 112 of the ties 108 are abutting against the side panels 604 of the form. In this manner, the ties 108 may serve not only as connectors, but also as anchors for holding positions of the insulating panels 602 while concrete is being poured into the form. It is understood that other cast-in-place applications may also appreciate the ties of the present disclosure.

Figure 35:
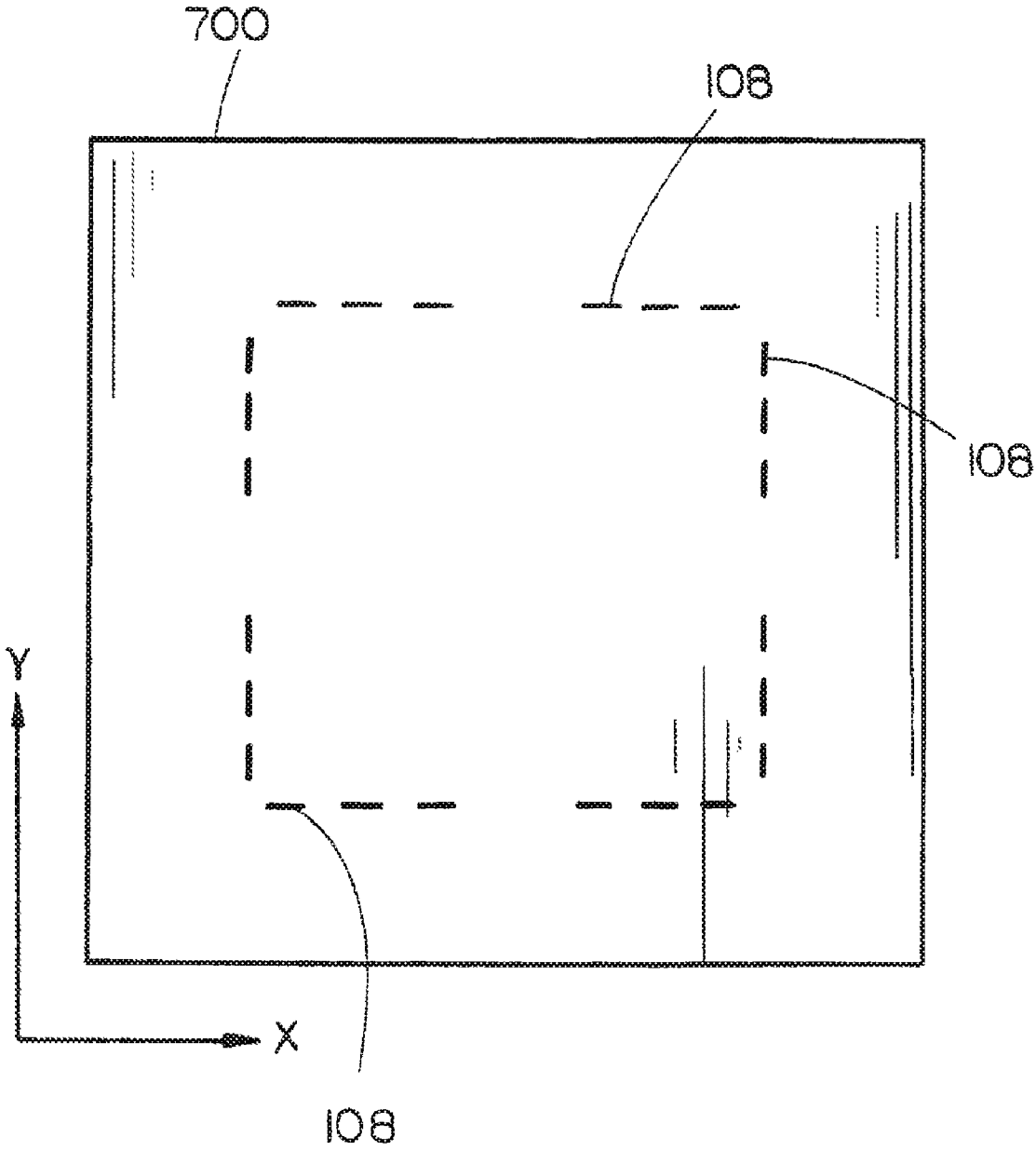
FIG. 35 is a top view of an insulating panel having a plurality of ties configured for distributing stress in two directions.
Figure 36:
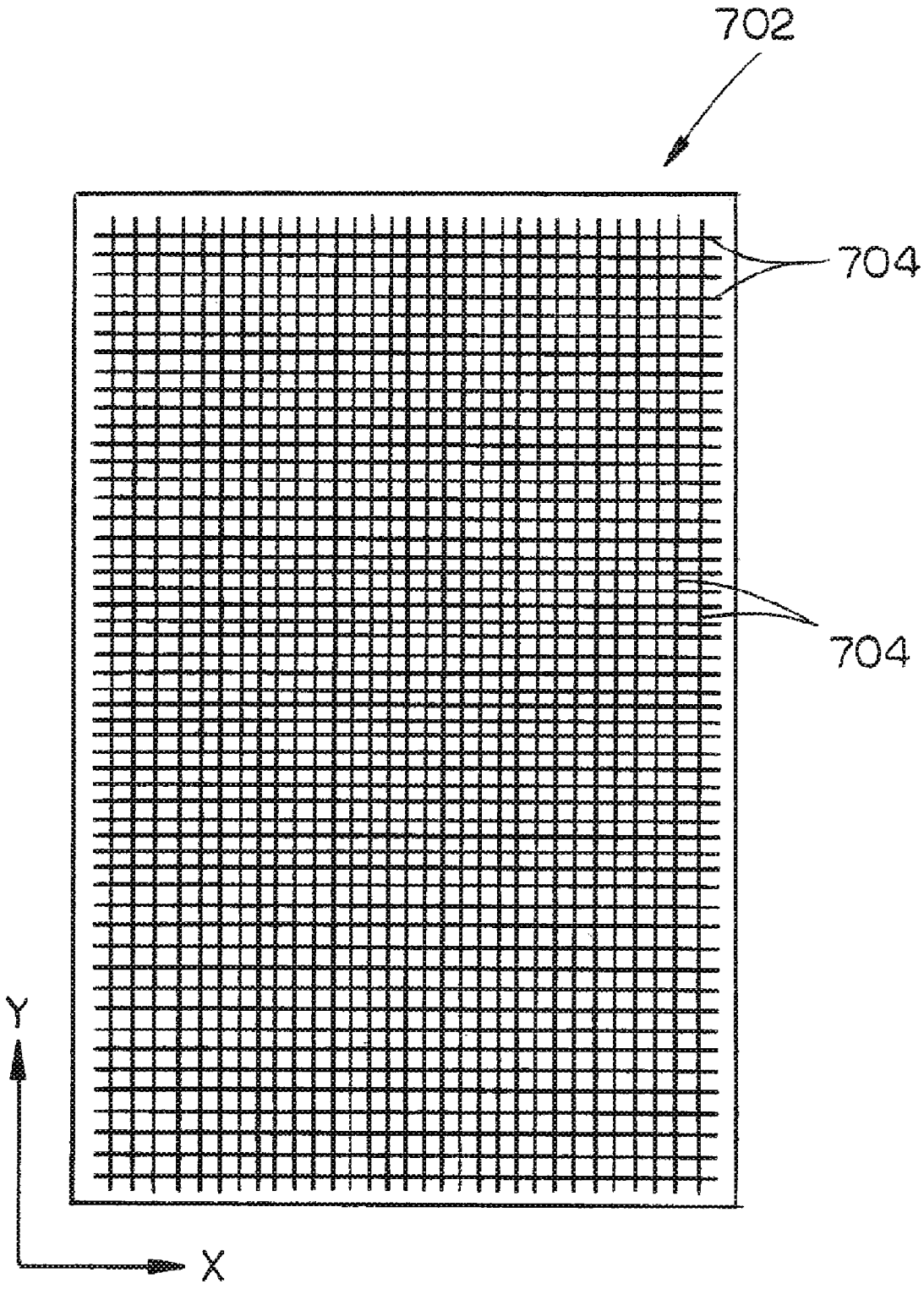
FIG. 36 is a top view of a panel forming system wherein the reinforcement installation of the first layer of concrete is installed.
Figure 37:
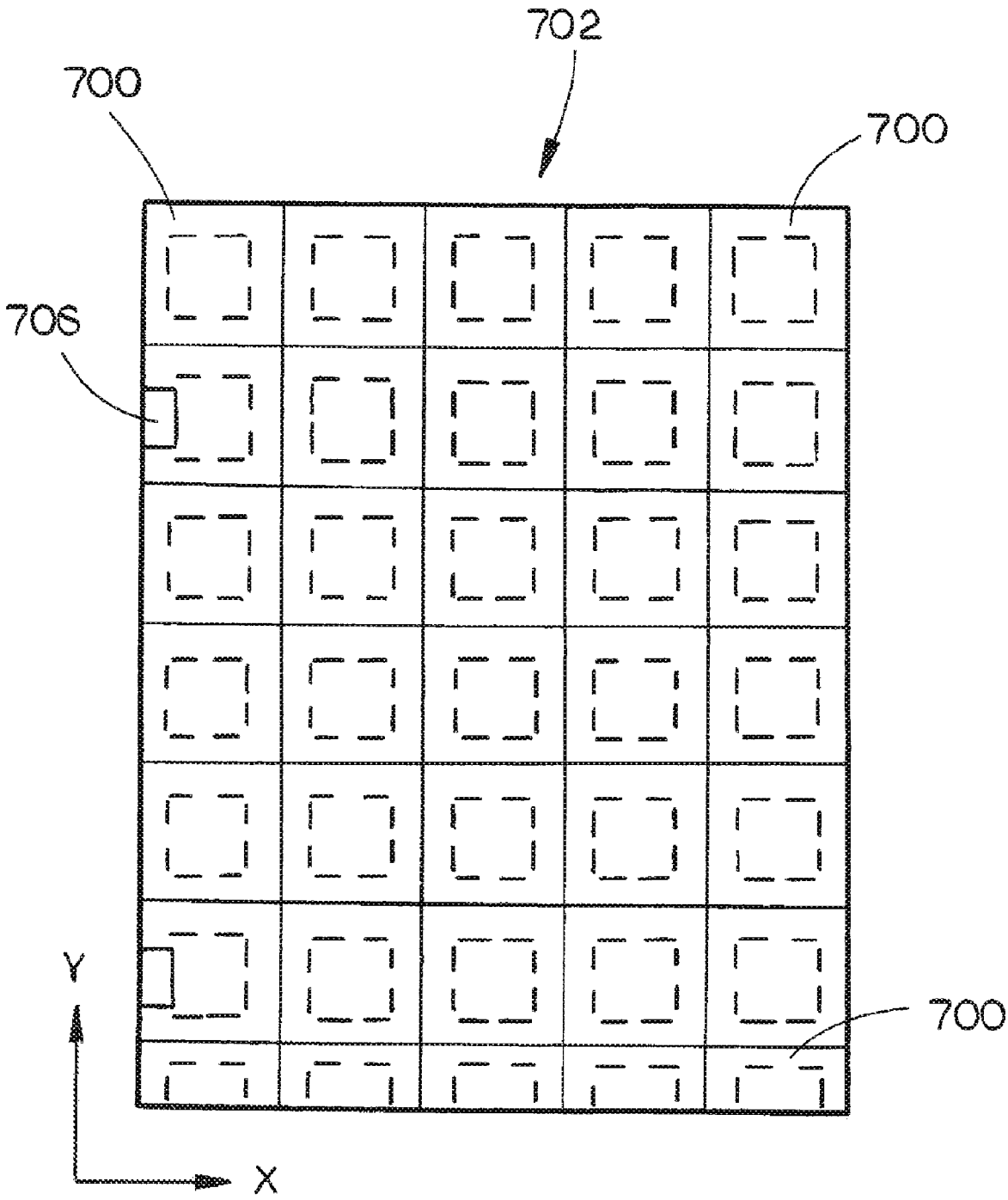
FIG. 37 is a top view of the panel forming system wherein the insulating panels having ties configured for distributing stress in two directions are installed.

Referring to FIGS. 35 through 37, the ties in accordance with the present disclosure may also be utilized for constructing sandwich panels having two-way slab configurations. Such two-way action sandwich panels may be utilized as floor elements that may be supported by columns on the corners of the sandwich panels without any additional load bearing beams or walls. In such a configuration, the ties 108 may be arranged for distributing the stress in both x and y directions of the sandwich panels.

As illustrated in FIG. 35, the insulating panels 700 may be configured as generally square shaped panels having a plurality of ties 108 arranged in both x and y directions. In one embodiment, the insulating panel 700 may be, for example, a 1.2 meter by 1.2 meter insulating board having eight ties 108 arranged in a generally square arrangement. It is understood that the dimensions of the insulating panel 700 and the arrangement of the ties 108 may vary without depart from the spirit and scope of the present disclosure.

The two-way action sandwich panel 702 may be manufactured by first defining the boundaries of the sandwich panel 702 on a panel forming bed. Reinforcement mats (e.g., rebars 704 arranged in a perpendicular configuration as depicted in FIG. 36) may be installed for the bottom layer of the sandwich panel, and a layer of concrete may be poured to form the bottom layer. The insulating panels 700 having a plurality of ties 108 arranged in both x and y directions may be placed on top of the bottom layer to form the insulating layer as depicted in FIG. 37. It is understood that cut out area 706 as previously described may be defined in the insulating panels to accommodate column locations, openings for passage of utilities, handling points, and/or other insertions. It is also understood that the dimension of the insulating panels 700 may vary based on the configuration of the sandwich panel 702. That is, certain insulating panels 700 may not be square in shape and/or may not contain the same number of ties 108 as other insulating panels.

In one embodiment, once the insulating layer is formed, a second reinforcement mat is installed for the top layer of concrete in the sandwich panel and fixedly attached to the ties 108 to form a strong three-dimensional truss. The sandwich panels are transported to the work site prior to pouring the top layer. The partially completed sandwich panels may be positioned in to their corresponding positions at the work site to form the floor. Once all of the partially completed sandwich panels are positioned for the entire floor, the top layers of the sandwich panels may be poured at once at the work site. In this manner, a continuous surface may be provided for the entire floor. For this system, there is no need to provide temporary supports under the sandwich panels except at the column locations. The partially completed panel is designed to resist its own weight and the weight of the topping fresh concrete and the weight of the construction workers and equipment, while the two-way action sandwich panels illustrated in the exemplary embodiments above can be of any general shape in a plan view and is not required to be rectangular as in one-way systems.

The methods disclosed may be implemented as sets of instructions, through a single production device, and/or through multiple production devices. Further, it is understood that the specific order or hierarchy of steps in the methods disclosed are examples of exemplary approaches. Based upon design preferences, it is understood that the specific order or hierarchy of steps in the method can be rearranged while remaining within the scope and spirit of the disclosure. The accompanying method claims present elements of the various steps in a sample order, and are not necessarily meant to be limited to the specific order or hierarchy presented.

It is believed that the system and method of the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory.

What is claimed is:

1. A concrete sandwich panel, comprising:

a first reinforced concrete panel;

a second reinforced concrete panel;

an insulating panel sandwiched between the first reinforced concrete panel and the second reinforced concrete panel;

a tie comprising a composite material having at least 65% fiberglass, the tie comprising a generally triangle wave-shaped pattern having a period defined by peaks spaced at a regular interval and a peak-to-peak amplitude greater than the thickness of the insulating panel;

wherein the insulating panel has a plurality of generally linear slots defined at the regular interval of the tie for receiving the tie such that opposing ends of the tie terminate adjacent to the insulating panel, and the plurality of generally linear slots are filled utilizing an insulating material upon insertion of the tie to reduce thermal bridging;

wherein the peaks of the tie mechanically join the first and second reinforced concrete panels to the insulating panel; and wherein the first reinforced concrete panel comprises a first reinforcement installation and the second reinforced concrete panel comprises a second reinforcement installation, and the tie is not secured to the first reinforcement installation and the second reinforcement installation.

2. The concrete sandwich panel of claim 1, wherein the tie has a length which is a segment of a length of the first reinforced concrete panel.

3. The concrete sandwich panel of claim 1, wherein the tie has a generally circular cross-section having a diameter of at least ¼ of an inch.

4. The concrete sandwich panel of claim 1, wherein the generally triangle wave-shaped pattern has a wavelength of at least 12 inches.

5. The concrete sandwich panel of claim 1, wherein the opposing ends of the tie are oriented generally parallel to a surface of the insulating panel for terminating adjacent to the insulating panel.

6. The concrete sandwich panel of claim 5, wherein substantially all surfaces of the opposing ends of the tie is touching the surface of the insulating panel.

7. The concrete sandwich panel of claim 1, wherein the peaks of the tie are rounded.

8. The concrete sandwich panel of claim 1, wherein the first reinforcement installation and the second reinforcement installation comprise means for resisting bending moment.

9. The concrete sandwich panel of claim 8, wherein the first reinforcement installation and the second reinforcement installation further comprise means for imparting tensile strength.

* * * * *